US005787974A

United States Patent [19]

Pennington

[11] Patent Number: 5,787,974

[45] Date of Patent: Aug. 4, 1998

[54] SPIRAL HEAT EXCHANGER AND METHOD OF MANUFACTURE

[76] Inventor: Robert L. Pennington, 809 73rd St., Brooklyn, N.Y. 11228

[21] Appl. No.: 488,048

[22] Filed: Jun. 7, 1995

[51] Int. Cl.[6] ..... F28D 9/04

[52] U.S. Cl. ..... 165/164; 165/67; 165/72; 165/DIG. 355

[58] Field of Search ..... 165/72, 67, 163, 165/164, 166

[56] References Cited

U.S. PATENT DOCUMENTS

| | | | |
|---|---|---|---|
| 2,131,265 | 9/1938 | Bichowsky | 165/164 |
| 2,136,153 | 11/1938 | Rosenblad | 165/DIG. 398 X |
| 2,360,739 | 10/1944 | Strom . | |
| 2,577,359 | 12/1951 | Phipps | 165/166 X |
| 3,762,467 | 10/1973 | Poon et al. . | |
| 3,921,713 | 11/1975 | Schmitzer et al. . | |
| 4,128,125 | 12/1978 | Borjesson et al. | 165/163 |
| 4,502,530 | 3/1985 | Huenniger | 165/72 |
| 4,577,683 | 3/1986 | Kelch . | |
| 4,907,647 | 3/1990 | Faller, Sr. et al. | 165/164 |

*Primary Examiner*—Allen J. Flanigan

*Attorney, Agent, or Firm*—Cowan, Liebowitz & Latman, P.C.

[57] ABSTRACT

A spiral heat exchanger is disclosed for indirect heat transfer between fluid media, primarily in heat recovery applications characterized by undissolved materials suspended in one or both fluid media. The heat exchanger has a transition chamber between the inlet for a fouling fluid (one which carries undissolved materials) and a heat exchanging passage for the fouling fluid. The transition chamber is has an enlarged cross section compared to the fouling fluid passage to collect undissolved material that may otherwise flow into the fouling fluid passage. This arrangement allows undissolved material to collect without completely blocking the fouling fluid passage. Easy access is provided to the transition chamber to remove collected undissolved material. A heat-conducting strip spirally wound within a shell or casing with opposite edges of the strip sealed to the casing defines two adjacent, spirally extending fluid passages. The strip is supported and sealed at opposite edges thereof without obstructing at least the fouling fluid passage. The seal may be accomplished by a sealant applied in liquid form which then hardens or cures. The heat exchanger is supported by a rigid support element or stanchion to which the strip is affixed and which extends as a mounting from the coiled strip so that the coiled strip may be supported thereby. Fluid inlet and outlet ports may also be affixed to and supported by the support element.

22 Claims, 12 Drawing Sheets

SPIRAL HEAT EXCHANGER AND METHOD OF MANUFACTURE

BACKGROUND OF THE INVENTION

This invention relates to heat exchangers, particularly to heat exchangers of the spiral plate type which typically form spiral passages for the fluid media from strip material.

Although practical designs for many heat exchanger applications were developed years ago, fouling, which is the deposition and accumulation of undissolved material in the passages or channels and chambers of a heat exchanger, poses special problems. Fouling is undesirable because it insulates the heat transfer surfaces from the fluid flowing through the passage or channel, causing a decrease in heat transfer, and because it restricts the flow of fluid through the affected passages of the heat exchanger by reducing the cross sectional area of the fluid passage and by increasing the friction between the fluid and the passage walls. The presence of undissolved materials suspended in fluid passing through a heat exchanger raises the likelihood of fouling. Because of fouling problems, no practical design to the applicant's knowledge has yet been widely accepted for many heat transfer applications.

Once a heat exchanger has become fouled, cleaning procedures are necessary to remove the accumulated material. These cleaning and maintenance procedures often add so much to the operating cost that many heat exchanger applications go unfilled. For example, in dish washer applications, each dish washing machine discharges several gallons per minute of waste water at approximately one hundred and fifty degrees Fahrenheit (150° F.) to the drain. Theoretically, the heat from this waste water could be recycled by a heat exchanger which cools the waste water and heats the incoming clean water. Because of fouling by materials washed off the dirty dishes, no heat exchanger has yet been recognized as offering an acceptable combination of resistance to fouling, low operating cost, and low manufacturing cost.

Many design parameters affect fouling tendencies. They include fluid velocity, availability of multiple parallel fluid passages, and obstructions in the fluid passages. High fluid velocities and the shear forces associated therewith tend to impede suspended matter from settling onto the wetted perimeter of fluid passages, and material which has settled tends to be loosened and carried away by these shear forces and by impacts with solids suspended in fast moving fluid. On the other hand, fouling is promoted by low fluid velocities, which may be caused within heat exchanger passages by channel shapes which distribute flow unevenly across the available cross section, such as on the shell side of a shell and tube heat exchanger.

Also, fouling is promoted in heat exchangers having multiple parallel fluid passages. Fluids carrying undissolved fouling material (such a fluid being referred to herein as a "fouling fluid") tend to distribute material deposits unevenly inside available parallel passages. A deposit of fouling material which partially obstructs one passage in a multiple parallel passage heat exchanger, causes the velocity through that one passage to drop while causing the fluid velocity in other passages to increase. This decrease in velocity promotes additional accumulation of fouling material in the obstructed passage. This mechanism for fouling explains why fouled passages of shell and tube bundles have the inside of some tubes completely blocked by accumulations, while other passages contain almost no deposits.

Fluid passages which are completely blocked tend not to be responsive to chemical cleaning procedures such as circulating a bleach, caustic, or acid solution through the passage. Instead, expensive disassembly and mechanical cleaning is usually required.

As mentioned above, fouling is promoted by obstructions in the fluid passage where solids such as fibers can be caught, and which create areas of low velocity in their proximity where undissolved material accumulates. The spiral heat exchangers described in U.S. Pat. Nos. 2,360,739 to Strom (1944) and 3,921,713 to Schnitzer et al. (1975) have structure extending between the coiled heat transfer surfaces to set the spacing between the heat transfer surfaces. This structure partially obstruct the fluid passage into which it protrudes, limiting the application of those heat exchangers. The spiral heat exchanger described in U.S. Pat. No. 3,762,467 to Poon et al. (1973) also has structure between the heat exchange surfaces, and incorporates a filter for removing fibers and other solids before the fouling fluid enters the heat transfer fluid passage. The need to frequently clean the filter in applications involving large quantities of undissolved materials makes this heat exchanger impractical for such applications.

Many unfilled heat exchanger applications, such as the aforementioned dish washer application or recycling heat from wash water in laundromats, involve only a few thousand dollars worth of energy recovery per year per installation. For a new heat exchanger design to be practical for a wide range of applications, both the initial cost and the operating cost of the exchanger must be low.

To achieve low production cost, the exchanger design should minimize material costs and the total cost of all fabrication procedures such as casting, cutting, shaping, welding, machining, and final assembly.

Spiral heat exchangers such as the one described in U.S. Pat. No. 2,360,739 to Strom require much welding and milling, which increases manufacturing costs. U.S. Pat. No. 4,577,683(1986) to Kelch suggests forming a heat transfer duct member, which defines the heat transfer fluid passages, in a mold. An expensive mold, machined to tight tolerances appears to be required for each desired channel configuration, and production appears to be limited to factories equipped with furnaces for melting metal, or equipped with injection molding equipment used to form ducts of plastic.

SUMMARY AND OBJECTS OF THE INVENTION

Several objects of the present invention are:

(a) to provide a simple, compact, efficient heat exchanger;

(b) to provide a heat exchanger fabricated by means of a simple and inexpensive procedure;

(c) to provide a heat exchanger for which the design and the fabrication procedures are easily and inexpensively adapted for a wide variety of applications;

(d) To provide a sturdy and durable heat exchanger, which is tolerant of abuse during installation, operation, and maintenance;

(e) to provide a heat exchanger which is resistant to the deposition and accumulation of undissolved materials;

(f) to provide a heat exchanger which is easy and inexpensive to clean;

(g) to provide a heat exchanger which is safe to manufacture, install, operate, and maintain;

(h) to provide a heat exchanger to which a manufacturer can easily and inexpensively give any of a variety of distinctive appearances.

Further objects are: to provide a heat exchanger which is suitable for recovering thermal energy from waste water, especially waste water containing undissolved solids; to provide a heat exchanger which offers savings of utility costs far in excess of the installed cost of the heat exchanger for a large number of end users; to provide a heat exchanger which requires a low start up cost of production, making it feasible to manufacture on a small scale, and to provide a heat exchanger which can be produced in a wide variety of distinct models by one manufacturer who benefits from economies of scale. Still further objects and advantages will become apparent from a consideration of the ensuing description and drawings.

The invention achieves the above and other objects by providing a heat exchanger for indirect heat transfer between fluid media in accordance with one or more of the following.

A transition chamber is provided between the inlet for the fouling fluid and a heat exchanging passage for the fouling fluid (where substantial heat exchange between the fouling fluid and the other fluid medium takes place). The fouling fluid flows through the transition chamber before entering the fouling fluid heat exchanging passage. The transition chamber is configured to collect undissolved material that may otherwise flow into the fouling fluid heat exchange passage. For example, the cross section of the transition chamber may be substantially larger than the cross section of the fouling fluid passage and preferably includes a throat section in which the chamber transitions to the cross section of the fluid passage. This arrangement allows undissolved material to collect without completely blocking the fouling fluid passage. Should undissolved material collect in the transition chamber so as to slow the throughput of fouling fluid in the fouling fluid passage, that can easily be detected and remedial action taken such as introducing a chemical cleaning agent or removing the undissolved material before a complete blockage can occur. Preferably, easy access is provided to the transition chamber to remove collected undissolved material. A transition chamber may also be provided for the other fluid used in the heat exchanger, which may be either a clean fluid (one without substantial amounts of undissolved material) or another fouling fluid. Use of a transition chamber avoids the need for a filter and the problems associated therewith. Preferably, the transition chamber feeds a single heat exchanging fluid passage, although it may feed multiple heat exchanging fluid passages and still realize at least some of the benefits described above.

A single fluid passage is provided for the fouling fluid. This avoids the problem associated with parallel flow passages where one or more flow passages can become blocked without a decrease in throughput, which could reduce the heat exchanging characteristics of the heat exchanger. Preferably, the single fluid passage extends helically in the heat exchanger, and the heat exchanger is a spiral heat exchanger. Preferably, the heat exchanger is a spiral heat exchanger which includes a single, helically extending flow passage for the fouling fluid and the transition chamber described above.

A spiral heat exchanger according to the invention has two heat exchanging fluid passages defined by a heat-conducting strip spirally wound within a shell or casing with opposite edges of the strip sealed to the casing to define two adjacent, spirally extending fluid passages of substantial length in a heat exchanging relationship with each other for substantial lengths thereof. The strip is supported and sealed at opposite edges thereof without obstructing at least a fluid passage which conducts a fouling fluid, and preferably without obstructing either fluid passage, i.e., no spacing or supporting structure extends into at least the fouling fluid passage and preferably both fluid passages. The seal is preferably accomplished by a sealant that may be applied in liquid form and which thereafter hardens or cures, as described below.

The sealing and spacing of the helically wound strip may be accomplished in accordance with the invention by a sealant that is introduced to one or both edges of the strip in liquid form and held there for a sufficient time for the sealant to harden. In addition to sealing one or both edges of the strip, the sealant preferably also engages the strip to space adjacent runs thereof. The sealant thus need not protrude into the fluid passages defined by the helically wound strip, and yet can maintain the spacing between adjacent runs of the strip.

A spiral heat exchanger having a helically wound coil may be supported in accordance with the invention by a rigid support element or stanchion to which the coil is affixed and which extends from the coil so that the coil may be supported by means of the support element. For example, the support element may have a mounting portion extending from the coil which may be bolted to a support structure. Preferably, the coil is the helically wound strip described above, which is affixed to the support element by the sealant described above. In that embodiment, one edge of the strip is adjacent the support element when the sealant is introduced, which when it hardens bonds the strip to the support element. The support element may also include structure adapted to receive or engage the coil. Also, the support element may be used to affix and/or support the shell of the heat exchanger, and/or a removable or permanently affixed end plate thereof, and/or a removable cover which provides access to the interior of the heat exchanger for service or maintenance purposes. Fluid inlets and outlets may also be affixed to and supported by the support element.

A heat exchanger according to one embodiment of the invention comprises a first fluid inlet, a first chamber in communication with the first fluid inlet, a first fluid outlet, a first fluid passage of substantial length communicating the first fluid inlet and the first fluid outlet, with the first fluid chamber defining a fluid passage between the first fluid inlet and the first fluid channel which is substantially larger in cross section than the first fluid passage. The heat exchanger also includes a second fluid inlet, a second fluid outlet, and a second fluid passage of substantial length communicating the second fluid inlet and the second fluid outlet and being in a heat-exchanging relationship with the first fluid passage for substantial lengths thereof The heat exchanger according to this embodiment:

- may include a second fluid chamber communicating the second fluid inlet with the second fluid passage, where the second fluid chamber defines a fluid passage between the second fluid inlet and the second fluid channel which is substantially larger in cross section than the second fluid passage;
- may be provided with an opening to the first fluid chamber accessible from the exterior of the heat exchanger and means for selectively closing the opening, and where a second fluid chamber is provided, an opening thereto accessible from the exterior of the heat exchanger and means for selectively closing the opening;
- may be a spiral heat exchanger comprising a single first fluid passage and a single second fluid passage each extending spirally within the heat exchanger, and may comprise a spirally wound, heat-conducting strip and means for closing off and/or sealing opposed edges of the strip and/or spacing adjacent runs of the strip as described herein;

may also comprise a support element as described herein.

A spiral heat exchanger according to an embodiment of the invention comprises a shell, a heat-conducting strip spirally wound within the shell with opposite edges thereof sealed to the shell to define adjacent, spirally extending first and second fluid passages of substantial length in a heat exchanging relationship with each other for substantial lengths thereof, with at least the first fluid passage being unobstructed in-between the shell. The heat exchanger also includes a first fluid inlet communicating with the first fluid passage, a first fluid outlet communicating with the first fluid passage spaced a substantial distance from the first fluid inlet, a second fluid inlet communicating with the second fluid passage, and a second fluid outlet communicating with the second fluid passage spaced a substantial distance from the second fluid inlet.

A spiral heat exchanger according to an embodiment of the invention comprises a rigid support element, a spirally wound heat-conducting strip supported by the support element with opposite edges thereof sealed to define adjacent, spirally extending first and second fluid passages of substantial length in a heat exchanging relationship with each other for substantial lengths thereof, a first fluid inlet supported by the support element communicating with the first fluid passage, a first fluid outlet supported by the support element communicating with the first fluid passage spaced a substantial distance from the first fluid inlet, a second fluid inlet supported by the support element communicating with the second fluid passage, and a second fluid outlet supported by the support element communicating with the second fluid passage spaced a substantial distance from the second fluid inlet.

The spiral heat exchanger according this embodiment:

may have a first fluid chamber defined by the strip communicating the first fluid inlet with the first fluid passage, where the first fluid chamber defines a fluid passage between the first fluid inlet and the first fluid channel which is substantially larger in cross section than the first fluid passage;

may have a second fluid chamber defined by the strip communicating the second fluid inlet with the second fluid passage, where the second fluid chamber defines a fluid passage between the second fluid inlet and the second fluid channel which is substantially larger in cross section than the second fluid passage;

may have an opening to the first fluid chamber accessible from the exterior of the heat exchanger and means for selectively closing the opening;

may have an opening to the second fluid chamber accessible from the exterior of the heat exchanger and means for selectively closing the opening;

may have a shell which includes a sealant sealing one edge of the strip at least where the strip defines the first and second fluid passages and engaging the strip to space adjacent runs of the strip;

may have a shell which includes a gasket adjacent one edge of the strip at least where the strip defines the first and second passages, and a plate urging the gasket against the one edge of the strip effective to seal the one edge of the strip, where the plate may be removably mounted to the heat exchanger; and may have a rigid support element as described herein.

In any of the above embodiments, the heights of the fluid passages may vary over the length thereof within a predetermined range of heights and a predetermined frequency of variation, forming numerous convergences and divergences and frequently changing the direction of the fluid flow as a means of imparting turbulence into the fluid. Also, the heights of the fluid passages may vary over different predetermined ranges of heights for each fluid passage, as a means of establishing different fluid flow characteristics such as velocity, pressure drop, and Reynolds Number for each of the fluids flowing through the two fluid channels.

In achieving some of the above objects, the invention also provides a method for fabricating a spiral heat exchanger, comprising the steps of: holding a thermally conductive strip in a configuration which forms two adjacent helically extending fluid channels, installing an inlet port and an outlet port in communication with each of the two fluid channels, introducing a liquid sealant in contact with one edge of the strip until the sealant hardens to engage and maintain the wound strip and to seal the strip along the edge, and sealing the opposite edge of the strip.

The steps of holding the strip and introducing sealant may be carried out by holding the strip in a mold which maintains the configuration of the strip and introducing the sealant into the mold. The step of installing the inlet and outlet ports may be carried out by attaching them to a rigid support element and positioning the support element adjacent the strip while the sealant is introduced to attach the support to the strip by means of the sealant. The mold may be bonded to the strip by the sealant and become part or all of a shell of the heat exchanger.

In a specific embodiment, the heat exchanger comprises a coil which includes two separate and adjacent inner flow transition chambers, two separate peripheral flow transition chambers, and two separate and adjacent fluid channels all formed by a thin thermally conductive strip and sealant such that two fluid passage are provided which are unobstructed by protrusions from any wetted internal surface. Each passage is formed to connect one inner flow transition chamber, dedicated to that passage, and one peripheral flow transition chamber, dedicated to that passage, and is configured such that the fluid passages are helically wound around the inner flow transition chambers to form the coil with peripheral flow transition chambers at the outer surface. The heat exchanger includes a rigid support element or stanchion formed of rigid structurally strong material, such as metal plate, attached to the side of the coil, such that the stanchion is adjacent to all of the flow transition chambers. Inlets and outlets are arranged such that each flow transition chamber is accessed by an inlet or outlet extending through the exterior of the coil, through the stanchion, through the sealant, and through any other layers of material between the exterior of the coil and the flow transition chamber. The thin thermally conductive strip may be closed by sealant on only the edge which is adjacent to the stanchion, the other edge being closed by a removable cover fabricated of a structurally strong material such as metal plate and a gasket made of a resilient material such as nitrile rubber or other elastomer sheet. The cover is attached to the coil by a suitable arrangement of fasteners extending from the stanchion across the width of the coil, outside of the flow channels.

The stanchion may be increased in size such that it extends beyond the perimeter of the coil sufficiently to anchor the fasteners. The heat exchanger may be provided with an inspection port or opening of adequate size to at least one flow transition chamber to facilitate removal of undissolved solids. An inspection port cover and gasket is fastened to each inspection port. The number of the flow transition chambers are of a predetermined size, and are shaped and oriented approximately as the lower part of a cylinder with a horizontal axis, the cylinder having been divided by a plane parallel to the axis of the cylinder; and joined to the corresponding fluid channel along one edge formed by the intersection of the surface of the cylinder and the plane which divides the two parts of the cylinder. Each flow transition chamber is joined to the corresponding fluid channel at a throat region which is fabricated such that at no place throughout the length of the fluid channel is the channel height less than the channel height in the throat region, whereby undissolved material too large to pass through the fluid passage is contained within the flow transition chamber until it is removed through the maintenance port. The heights of the two fluid passages may be different for the two fluid passages, as a means of establishing different fluid flow characteristics (e.g., for introducing turbulence into the fluid) such as velocity, pressure drop, and Reynolds Number for each of the fluids flowing through the two fluid channels. The heights of the fluid channels may vary over the length of the fluid channels within a predetermined range of heights and a predetermined frequency of variation, forming numerous convergences and divergences and frequently changing the direction of the fluid flow as a means of imparting turbulence into the fluid. The thin thermally conductive strip used to form the heat transfer passages may have a protruding pattern such as a corrugated or ribbed pattern which includes irregularities across the direction of fluid flow, such that the distance between adjacent wraps varies repeatedly within a predetermined range of distances to serve as a means to impart turbulence to the fluid flowing through the passages.

A containment ring fabricated of a structurally strong material such as metal may surround the coil axially and be attached to the coil by sealant between the outer wrap of the coil and the containment ring. The heat exchanger includes a shell which encloses both sides of the coil including both edges of the inner flow transition chambers, both edges of the flow channels, and both edges of the peripheral flow transition chambers. The shell is fabricated of a material which gives an appropriate aesthetically attractive appearance to the heat exchanger such as corrosion resistant metal such as stainless steel, or plastic, and is attached to the coil by sealant on both sides of the coil. The shell may overlay a layer of filler material, and encases both sides of the coil, thereby serving to structurally support the sealant closing the edges of the coil, serving to insulate the coil from radiative heat transfer with its surroundings, and serving to give the heat exchanger the appearance of having been manufactured to high quality standards. In one embodiment, the shell is held firmly to the side of the coil opposite the stanchion by the cover over each maintenance port, and the shell is fabricated with appropriately sized holes which align with the maintenance port, and with each fluid passage.

The thin thermally conductive strip may be made of material such as stainless steel, aluminum, galvanized steel, or similar thermally conductive material, and the sealant may be an epoxy, urethane, silicone rubber or similar material which adheres to the strip, which hardens as the sealant cures, and which contacts a predetermined portion of the width of the strip as a means of maintaining the distance between adjacent wraps and as a means of closing the edge of the coil. Sealants satisfactory to perform these functions are readily commercially available from sources known to those of skill in the art.

The stanchion may have a 90° bend at one end which protrudes a predetermined distance from the main part to define amount portion for the coil. A suitable arrangement of bolt holes through the main portion enables the mount part to serve as a means to fasten the heat exchanger to a structure. The inlets and outlets through the stanchion are defined by a structurally strong material such as metal tubing or pipe which firmly attached to the stanchion, preferably by welding.

A specific embodiment of the method for fabricating the heat exchanger comprises the steps of: shaping a thermally conductive strip to form two center flow transition chambers, two helical fluid channels, and two peripheral flow transition chambers; joining each of the two ends of the strip to the adjacent inner wrap of strip by a means which results in a strong leakproofjoint; fabricating a stanchion subassembly which includes a brace, four fluid passages, and fasteners; bringing together the coiled strip, the stanchion, and liquid sealant in a mold such that each of the four fluid passages through the stanchion aligns with one of the four flow transition chambers formed by the strip, the fasteners extend across the width of the coil without obstructing any of the fluid channels or any of the throats where the fluid channels join the chambers; and the liquid sealant extends across the thickness of the brace and partially across the width of the coil such that when the sealant cures, the brace becomes attached to the coil, one edge of each of the four flow transition chambers and one edge of the helical fluid passages becomes closed in a mechanically strong and leakproof manner, and the distances between adjacent wraps forming the two center flow transition chambers, the two helically wound fluid passages and the two peripheral flow transition chambers becomes fixed; and closing the remaining open edge of the two center flow transition chambers, the two helically wound fluid passages and the two peripheral flow transition chambers by a means which results in a leakproof seal.

The thermally conductive strip may be shaped to form the two center flow transition chambers by locating a point near the center of the length of strip between blocks which in profile have the desired shape of the center flow transition chambers, and which do not extend across the width of the strip such that the blocks hold the strip in the desired shape and leave room for sealant to flow between adjacent wraps of strip without the blocks becoming bonded to the strip during the molding procedure; and winding the strip around the blocks. The thermally conductive strip is shaped to form the two helically wound fluid channels by placing flexible belts which do not extend across the width of the strip such that the belts hold the strip in the desired shape and leave room for sealant to flow between adjacent wraps of strip without the belts becoming bonded to the strip during the molding procedure. The strip and the belts are then wound around the center flow transition chambers and the thermally conductive strip is shaped to form the two peripheral flow transition chambers by placing blocks, which in profile have the desired shape of the peripheral flow transition chambers, against the adjacent inner wrap of strip at the desired locations such that the blocks hold the strip in the desired shape and leave room for sealant to flow between adjacent wraps of strip without the blocks becoming bonded to the strip during the molding procedure; and winding the strip over the blocks. After bonding the stanchion to the coil, the blocks and belts are removed through the remaining open edge of the two center chambers, the two helically wound fluid channels, and the two peripheral channels.

After bonding the stanchion to the coil to close the remaining open edge of the two center flow transition chambers, the two helically wound fluid channels and the two peripheral flow transition chambers, in another molding procedure the coil is positioned in a mold and liquid sealant is introduced such that the liquid sealant extends partially across the width of the coil, leaving an open space of approximately uniform width between the two layers of sealant deposited during the two molding procedures. A maintenance port is created into one or more flow transition chambers through the sealant which closes the edge of the chambers which is opposite the stanchion, and a removable maintenance port cover with a removable maintenance port cover gasket are provided to close the port before operation. The maintenance port cover and the gasket are positioned and attached to the side of the coil by fasteners in a tight leakproof manner.

The molds used in the procedures which combine sealant and strip, may be bonded by the sealant, and become part of all of the shell of the heat exchanger.

BRIEF DESCRIPTION OF THE DRAWINGS

In the drawings, closely related figures have the same figure number, but have different alphabetic suffixes. Also, the same reference numeral or the same reference numeral with different alphabetical suffixes in different figures indicates the same or a similar or related part.

REFERENCE NUMERALS IN DRAWINGS

Figure 1:
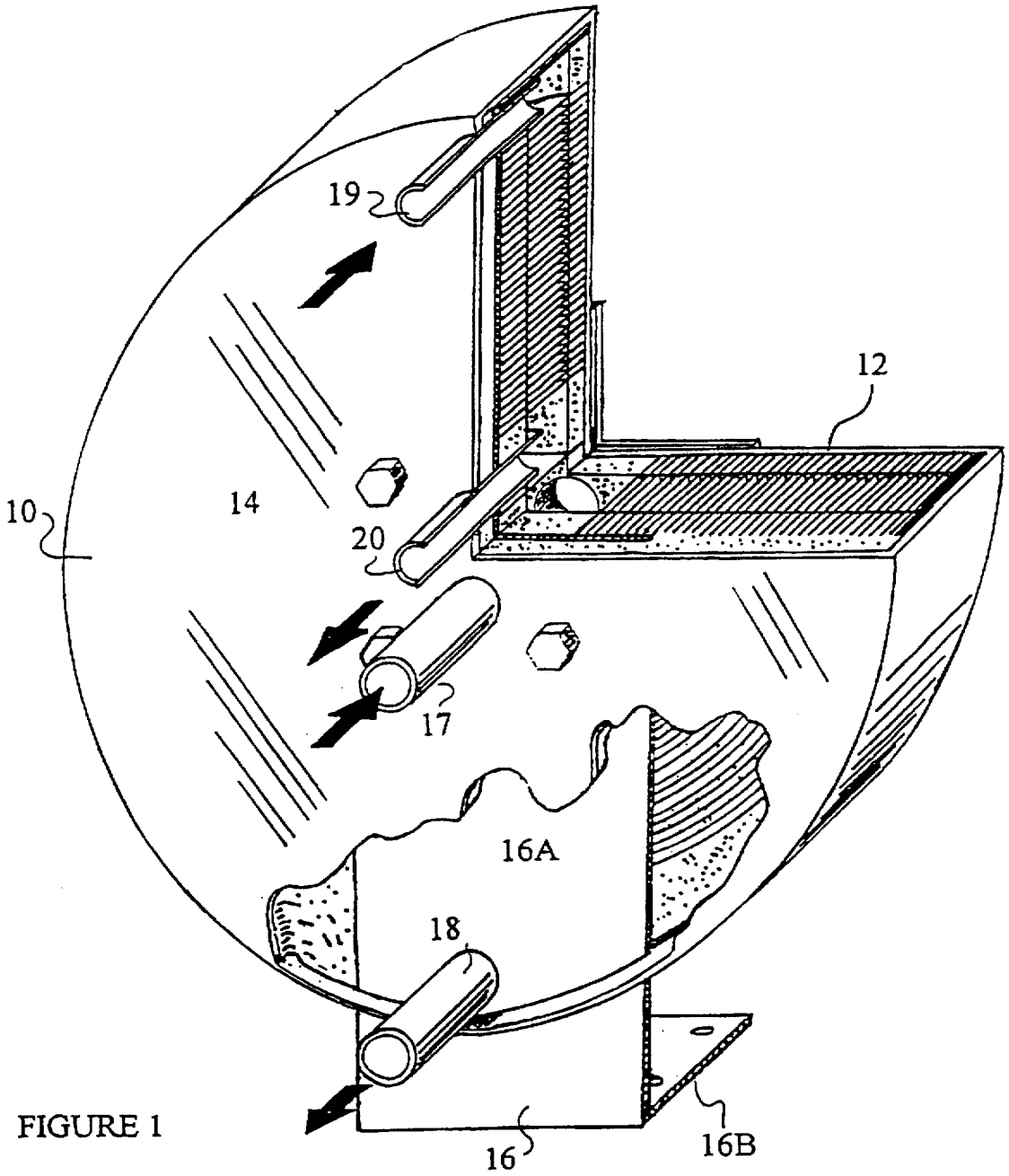
FIG. 1 is a rear perspective view, particularly in section and party broken away, of a heat exchanger according to the present invention.

10 heat exchanger
10A heat exchanger
10B heat exchanger
10C heat exchanger
12 heat transfer coil
13 strip
14 heat exchanger main part or body
16 stanchion
16A brace or central portion
16B mount or base portion
16C positioning guide portion
16D bolt holes
17 inlet port for fluid A
18 outlet port for fluid A
19 inlet port for fluid B
20 outlet port for fluid B
22 fluid passage for fluid A
24 fluid passage for fluid B
25 fastener
25A shank
25B washer
25C lock washer
25D nut
26 inspection port
28 raised ridge
30 coil center
31 tubular spacers
32 inspection port gasket
34 inspection port cover
40 center flow transition chamber for fluid A
40A throat
40B constriction at throat
42 peripheral flow transition chamber for fluid A
42A throat
44 center flow transition chamber for fluid B
44A throat
46 peripheral flow transition chamber for fluid B
46A throat
46B constriction at throat
50 channel terminal
51 sealant
52 casing
53 containment ring
54 containment plate
55 channel maintenance cover gasket
56 channel maintenance cover
58 fasteners at the periphery
60 hole in containment plate
62 washer
63 lock washer
64 nut
70 block shaped as center flow transition chamber for fluid A
72 block shaped as peripheral flow transition chamber for fluid A
74 block shaped as center flow transition chamber for fluid B
76 block shaped as peripheral flow transition chamber for fluid B
82 belt for fluid passage 22
84 belt for fluid passage 24
85 mold for first bonding procedure
85A cut away side section of the mold
87 opening in the mold for port 17
88 opening in the mold for port 18
89 opening in the mold for port 19
90 opening in the mold for port 20

DESCRIPTION OF THE PREFERRED EMBODIMENTS

FIGS. 1, 2, 3A, 3B, 4A, 4B

Figure 2:
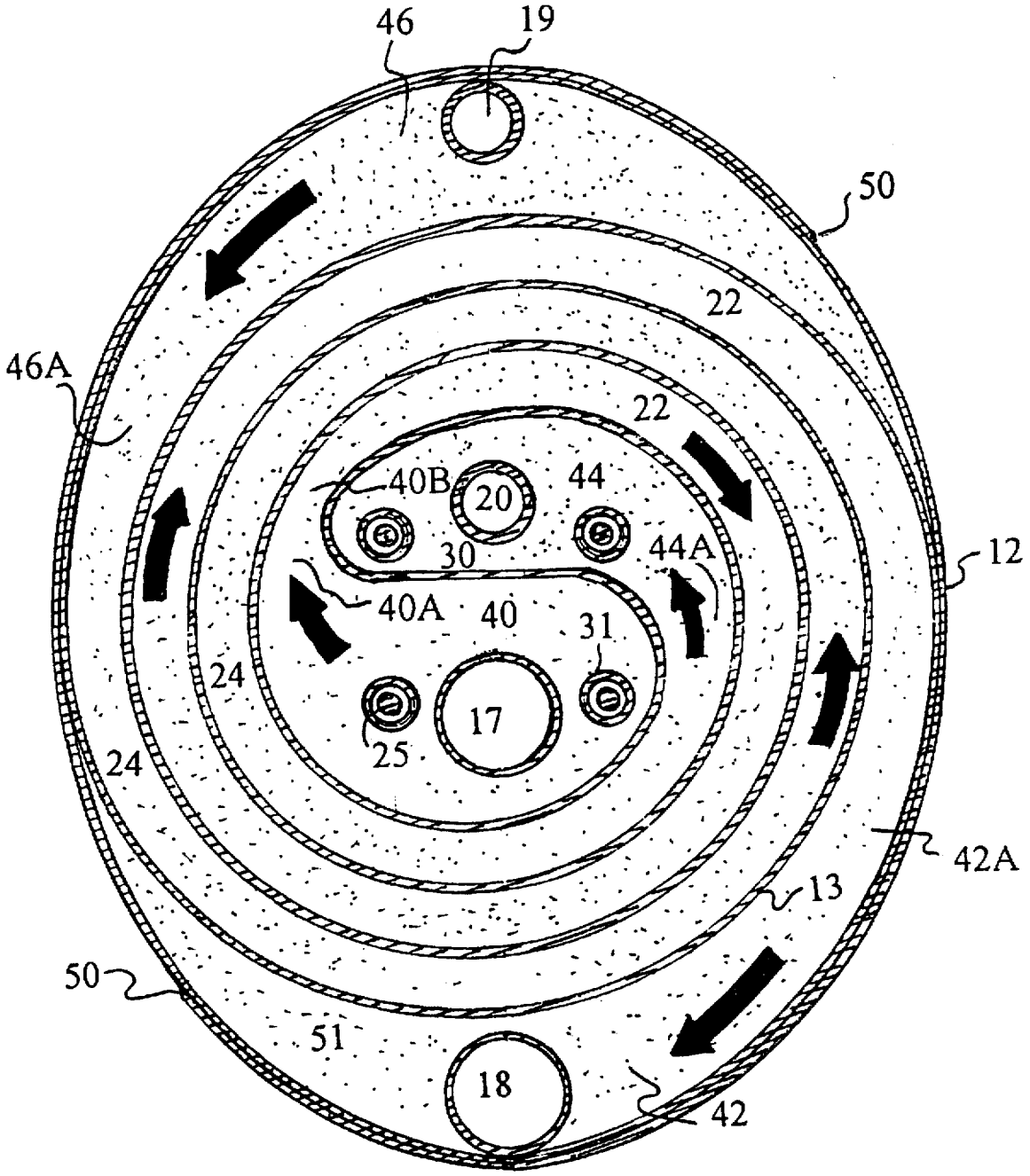
FIG. 2 is a radial section view of a heat exchanger according to the invention, but showing a reduced number of fluid passages enlarged for clarity.

A typical embodiment of a heat exchanger incorporating the present invention is illustrated in FIGS. 1 and 2. The heat exchanger 10 comprises a heat transfer coil 12 (shown in simplified profile in FIG. 2) attached to a rigid support element in the form of a stanchion 16. In the preferred embodiment, the shape of the main part or body 14 of the heat exchanger 10 is a cylindroid. The stanchion 16 includes a central or brace portion 16A within the body portion 14 of the heat exchanger and a base or mount portion 16B which protrudes from the body 14. Fluid ports 17–20, anchored to the stanchion central portion 16A, also protrude from the body 14. The coil 12 is formed of a single thin thermally conductive strip 13 helically wrapped or wound a number of times to define two spiral flow passages or channels 22, 24 within heat exchanger body 14. Fluid passage 22 conducts the fouling fluid, fluid A, and the fluid passage 24 conducts fluid B. To achieve adequate length, the strip 13 may be formed by joining two or more pieces of thin thermally conductive strip in a manner which results in a mechanically strong non-porous joint, for example, by welding. Stainless steel, galvanized carbon steel, and aluminum are typical materials suitable for use as thin thermally conductive strip 13. Ports 17 and 18 are in communication with fluid passage 22 and are inlet and outlet ports, respectively, for fluid A, and ports 19 and 20 are in communication with fluid passage 22 and are inlet and outlet ports, respectively, for fluid B. As mentioned, the fluid ports 17–20 are anchored to the central portion 16A of the stanchion 16.

However, ports may be formed and attached to the heat exchanger in other ways. For example, a hole may be bored through the shell of the heat exchanger to communicate with the desired passage or chamber. The hole may also be bored through the stanchion and threaded at the stanchion for receiving a threaded tube or pipe. Or bolts may be used to affix flanged tubes or pipes to the heat exchanger.

In the center of the coil 12, the strip 13, is shaped to form two distinct flow transition chambers 40 and 44. Chamber 40 serves to redirect fluid flow between fluid inlet port 17 and the corresponding fluid passage 22, and chamber 44 redirects fluid flow between passage 24 and the corresponding fluid outlet port 20. The center flow transition chambers 40 and 44 also serve as appropriate sites for the fasteners 25 at the coil center 30 to pass through the coil 12 such that the fasteners do not interfere with fluid flow through the fluid passages 22 and 24. In the preferred embodiment, when viewed radially, the center of the coil 12 appears shaped like the letter S with the lower loop of the S larger than the upper loop. The center flow transition chamber 40 for the fouling fluid, fluid A, is the larger chamber, which serves as the inlet for the fouling fluid. In the throat 40A where the fouling fluid exits the large center flow transition chamber 40 and enters the helical fluid passage 22, the strip 13 may be shaped to form a constriction 40B. The constriction 40B need not be severe. For a short length, the distance between adjacent wraps or runs of the strip 13 may be reduced to a distance which is slightly less than the distance between adjacent wraps forming any other part of the fluid passage 22.

A sufficient length of strip 13 is helically wound around the flow transition chambers 40, 44 to form the two separate helical fluid passages 22 and 24 of the desired length. The strip 13 forming the helical fluid passages 22, 24 may be shaped with a three dimensional pattern of alternating peaks and troughs oriented perpendicular to the length of the strip, or embossed with a different pattern. The minimum distance between adjacent wraps of the strip 13 forming one fluid passage may be different than the minimum distance between adjacent wraps of the strip 13 forming the other fluid passage, thereby creating fluid passages which may have different heights and different cross sectional areas for fluid flow.

The two peripheral flow transition chambers 42 and 46 are formed by increasing, then decreasing the distance between adjacent wraps of the strip 13 forming the two fluid passages 22 and 24. In the preferred embodiment these peripheral flow transition chambers are crescent shaped and diametrically opposed on the periphery of the coil 12, as illustrated by FIG. 2. The exterior wrap of the strip 13 is wound in contact with the adjacent inner wrap of the strip 13 which forms the peripheral flow transition chambers 42 and 46. A channel terminal 50 is formed where the exterior wrap of the strip 13 is fastened to the adjacent inner wrap of the strip 13 by a method which results in a strong non-porous joint, for example, by welding.

A sealant 51 adhering to the thin thermally conductive strip 13 closes off the edges, i.e., one side, of the spiral channels 22 and 24 and flow transition chambers 40, 42, 44, and 46 and bonds the strip 13 to the stanchion central or brace portion 16A. The sealant is a substance which adheres or bonds to metal and hardens from a fluid state as it sets. Epoxy is a suitable sealant for closing the edges of the spiral channels and flow transition chambers. Urethane, silicone rubber, fiberglass resin, or similar substances may also be used. The sealant 51 not only performs the sealing function but also a mechanical function of fixing adjacent wraps of the strip 13 at the desired spacing. The central portion 16A of the stanchion 16 functions as a brace for the wrapped strip 13.

Figure 3A:
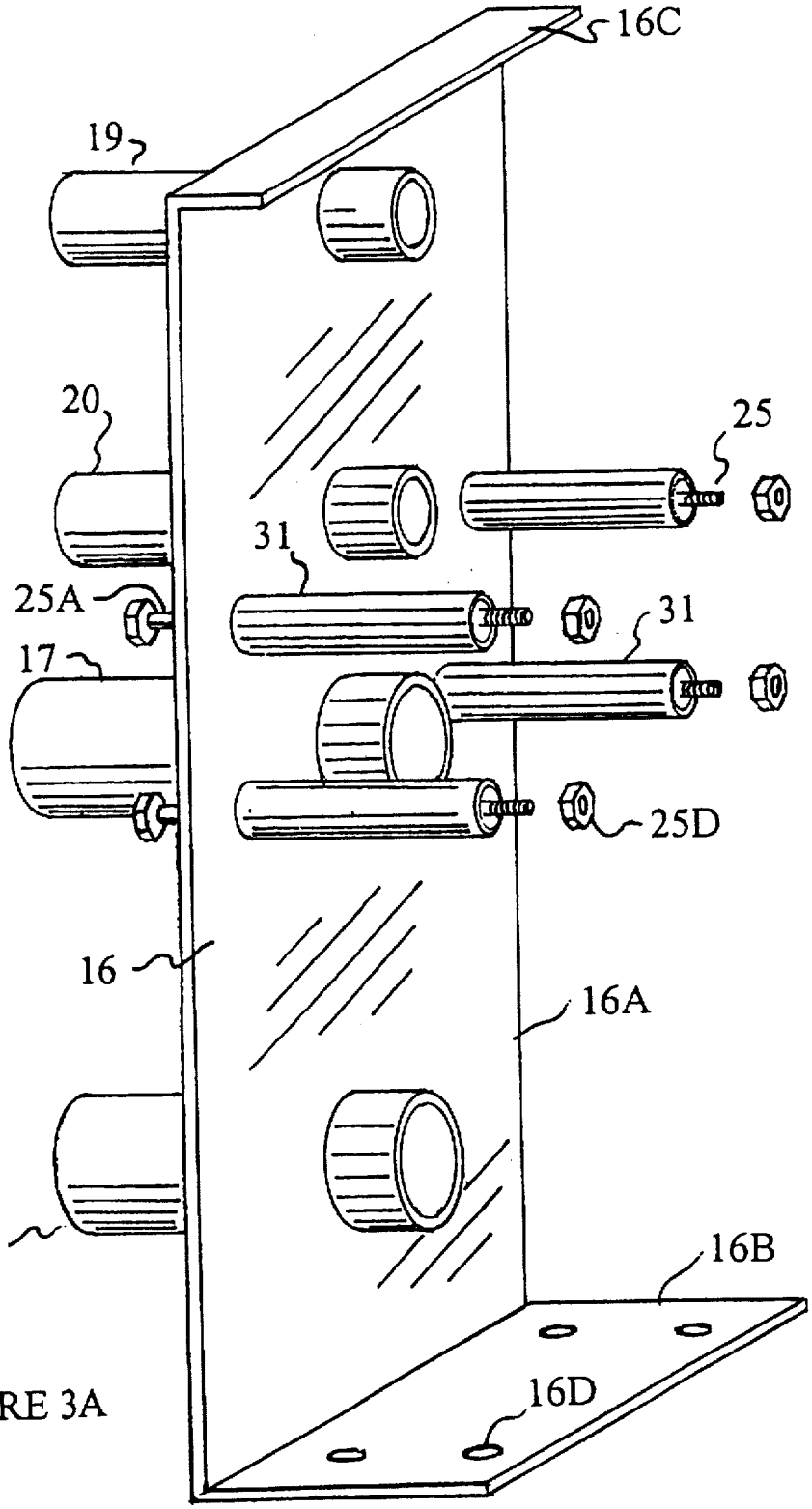
FIGS. 3A and 3B are front and rear perspective views aspects of a stanchion subassembly of the heat exchanger depicted in FIG. 1.

FIG. 3A (front view) and 3B (rear view) show the stanchion 16 subassembly. The stanchion 16 is fabricated of a structurally strong material, typically metal such as stainless steel, galvanized carbon steel, or aluminum. The stanchion includes the brace and mount portions 16A, 16B, and provides structural strength to the heat exchanger 10 by serving as a brace for the coil 13, as a secure frame for anchoring fasteners 25 and the fluid ports 17–20, and as the mount for the heat exchanger 10.

The mount portion 16B functions as a base of the heat exchanger 10 which is secured to a support structure. To serve this purpose, the mount portion 16B is typically oriented perpendicular to the plane of the brace portion 16A, and positioned beneath the coil 12, although other configurations adopted for the particular mounting structure involved may be used. The mount portion 16B typically has a number of bolt holes 16D therethrough. The brace portion 16A extends from the mount portion 16B for a distance greater than the largest diameter of the elliptical edge of the coil 12. At the end of the brace portion 16B opposite the mount portion 16A, a positioning guide portion 16C may be formed. The positioning guide portion 16C extends perpendicular to the brace portion 16A, above the coil 12. The length of the positioning guide portion 16C need not exceed the width of the coil 12. The positioning guide portion 16C serves to assist assembly of the heat exchanger 10 by facilitating alignment of the coil 12 onto the brace portion 16A. The four ports 17–20 which are anchored to the brace portion 16A (preferably are tubes made of the same material as the stanchion 16). They pass through and are securely anchored to the stanchion 16, preferably by welding. Two fluid ports 17 and 20 pass through the stanchion 16 near the center of the brace portion 16A. One fluid port 19 passes through the brace portion 16A near the positioning guide portion 16C; and one fluid port 18 passes through the brace portion 16A between the mount portion 16B and the center of the brace portion 16A.

Near the center of the stanchion brace portion 16A, a number of fasteners 25 extend from the stanchion 16. If nuts and bolts are used as fasteners, each bolt is securely anchored to the stanchion 16, preferably by welding. The shank 25A of each bolt extends through the coil 12 axially. The threaded portion of the shank 25A protrudes from the coil a distance adequate to facilitate installation of an inspection port gasket 32 and an inspection port cover 34, with a washer 25B, lock washer 25C, and nut 25D which are parts of the fastener 25. Tubular spacers 31 may be installed on the shanks 25A of some or all of the fasteners 25. Each tubular spacer extends from the coil side of the stanchion, across the width of the coil, to the outer surface of the coil. The tubular spacers 31 prevent the coil from damage if the fasteners 25 are over tightened. The fasteners 25 are arranged such that when the stanchion subassembly and the coil 12 are joined, the fasteners are positioned out of the fluid passages 22 and 24 and out of the throats 40A and 44A. In the preferred embodiment, the fasteners 25 pass through the center flow transition chambers 40 and 44, and are arranged near the perimeter of the center flow transition chamber 40A for fluid A.

Figure 4A:
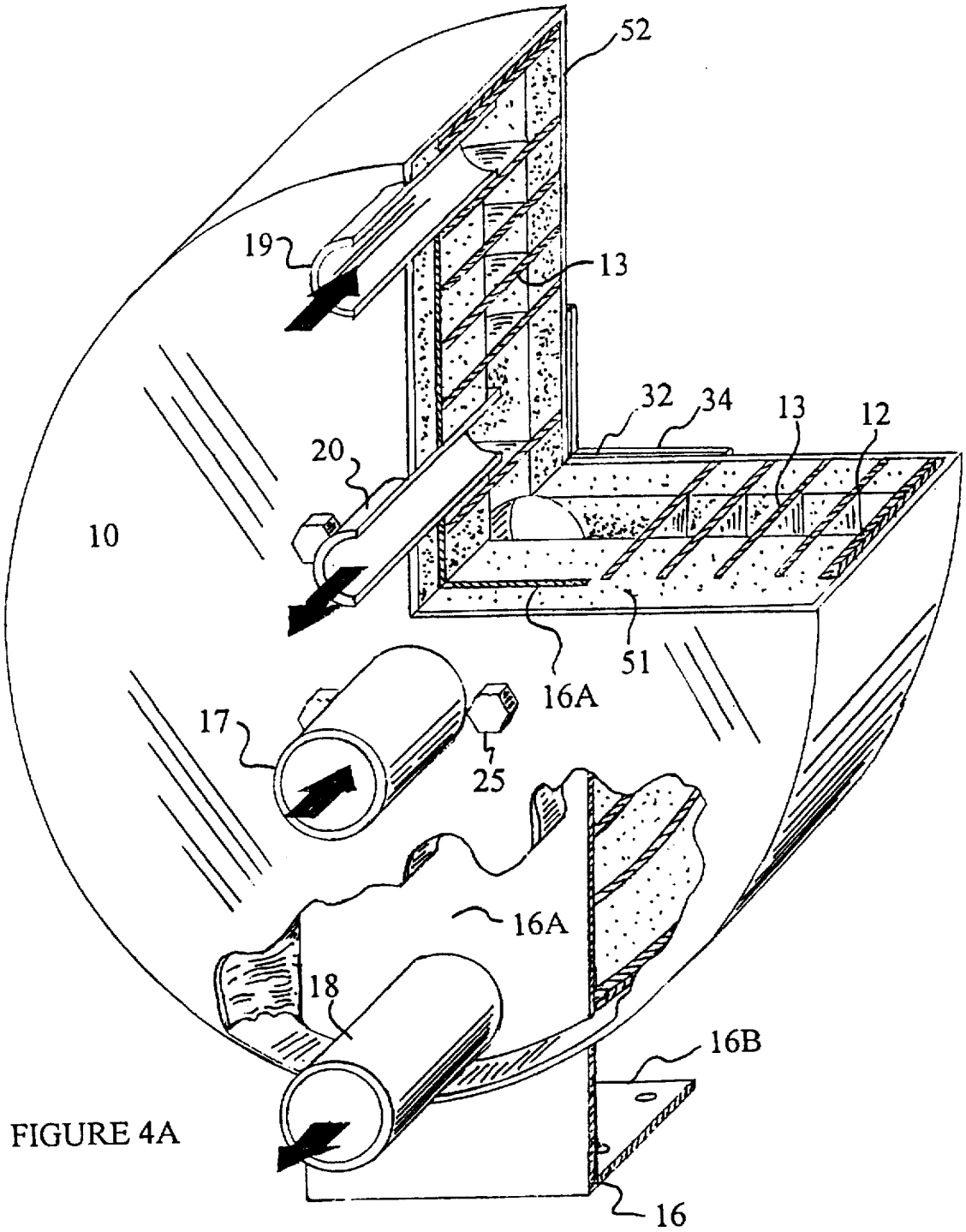
FIG. 4A is a schematic rear perspective view, partly in section and partly broken away, of the heat exchanger depicted in FIG. 2.

FIG. 4A shows that on the coil side of the stanchion, the fluid ports 17–20 extend through the sealant 51 used to seal the edge of the coil 12 adjacent to the stanchion. Each of the four fluid ports 17–20 align with and enter one of the four flow transition chambers 40, 42, 44, and 46, respectively.

A casing or shell 52 fabricated of plastic or metal overlaying a layer of sealant 51 or other filler material may encase the sealant 51 closing the edges of the coil 12. A shell 52 fabricated of metal or plastic overlaying a layer of insulating material (not shown) slows heat losses during operation, and makes the exchanger safer to touch. To serve this purpose, the shell may be shaped to facilitate placement of a layer of insulation against the coil 12 and brace portion 16A. Since the shell 52 serves no purpose in the basic operation of the heat exchanger, it may be omitted without adversely affecting thermal performance. However, a shell is preferred for the reasons stated above and because it gives the heat exchanger 10 a sturdy appearance and an attractive finish.

In accordance with the invention, the edges or ends of the strip 13 forming the passages 22, 24 are closed with the sealant material 51 in a mold. In the preferred embodiment, the mold comprises sections of the shell 52, typically, formed of plastic or metal such as thin stainless steel. In those embodiments, the mold becomes part of the heat exchanger. However, in other embodiments, a shell is formed around the heat exchanger in a reusable mold which does not become part of the heat exchanger. The shell may be given an appearance characteristic of the company supplying the heat exchanger to the market.

Figure 4B:
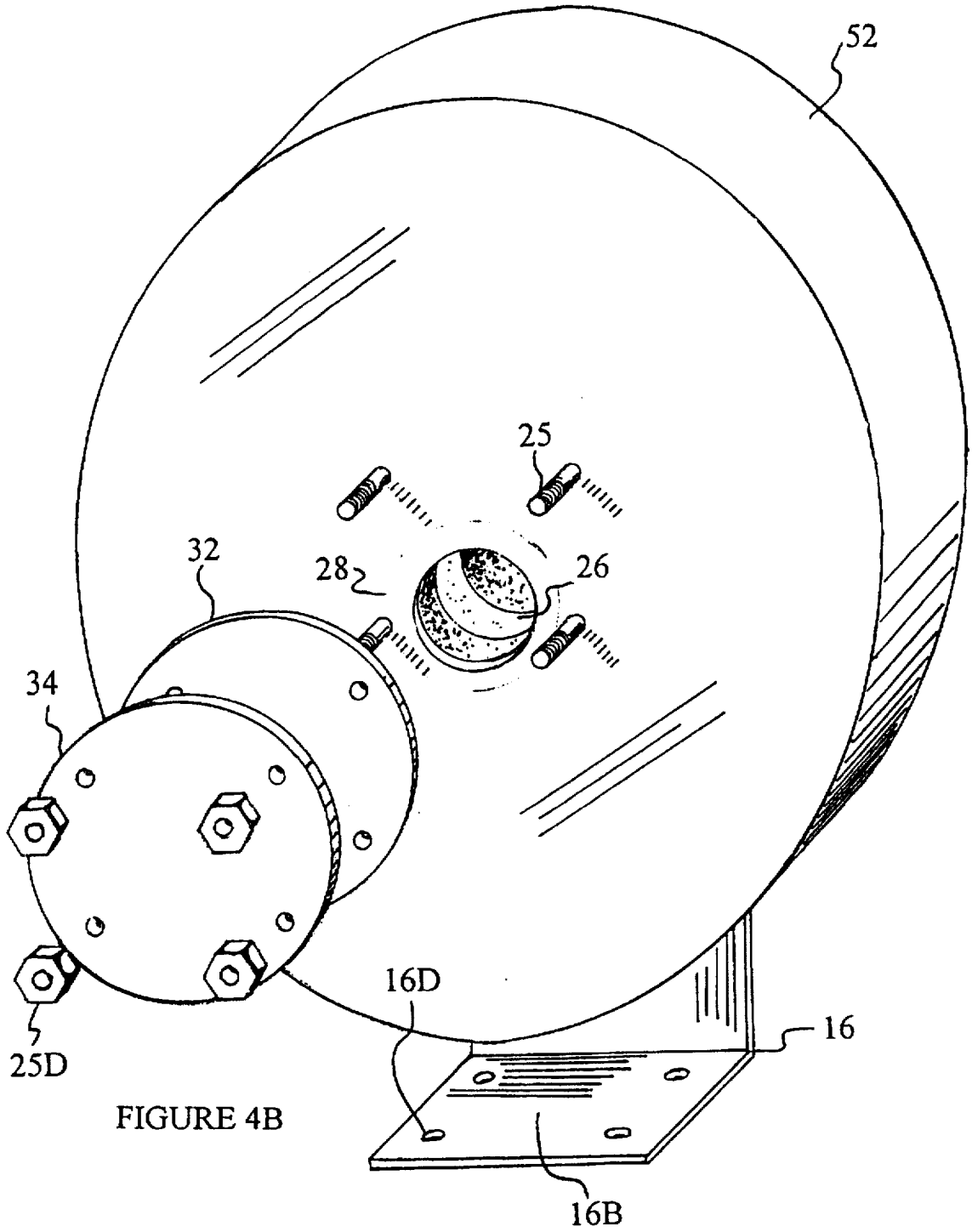
FIG. 4B is a front perspective view, partially exploded, of the heat exchanger depicted in FIG. 2.

FIGS. 4A and 4B show opening or inspection port 26 which extends axially through the shell 52 and sealant 51 into the center flow transition chamber 40 for fluid A. The inspection port 26 is located near the center 30 of the coil 12 on the side opposite the brace portion 16A of the stanchion 16. The cross sectional area of the inspection port 26 is sufficient to permit removal of solids which are small enough to enter the flow transition chamber through the fouling fluid inlet port 17, but too large to pass through the constriction 40B in the throat 40A. The cross sectional area of the inspection port 26 is larger than the cross sectional area of the inlet port 17 into the center flow transition chamber 40 for fluid A, and is larger than the cross sectional area of the fluid passage 22 for fluid A. A small raised ridge 28, or a number of small ridges, may encircle the inspection port 26. The ridge or ridges 28 are located on the shell 52, or on the edge of the coil 12 when no shell is used. The inspection port 26 is closed and sealed by an inspection port cover 34 and an inspection port gasket 32.

The ridge or ridges 28 are usually located between the inspection port 26 and the fasteners 25 at the coil center 30, which attach the inspection port cover 34 to the heat exchanger. The ridge or ridges serve to assure a better seal by the inspection port gasket 32 between the inspection port cover 34 and the shell 52, or the coil 12 when no shell is used. The inspection port cover 34 is fabricated of a structurally strong and rigid material, preferably metal such as stainless steel, galvanized carbon steel, or aluminum. The inspection port cover 34 is located over both the center flow transition chamber 40 for fluid A, and over the center flow transition chamber 44 for fluid B. This placement of the inspection port cover 34 uses the structural strength of the inspection port cover 34, the fasteners 25 at the coil center, and the brace portion 16A to support the sealant 51 which close the edges of the two center flow transition chambers 40 and 44. The inspection port cover 34 has a number of holes therethrough corresponding to the fasteners 25 extending from the stanchion 16 and protruding from the coil 12. The inspection port gasket 32 is placed between the inspection port cover 34 and the shell 52, or between the inspection port cover 34 and the edge of the coil 12 when no shell is used. The surface area of the inspection port gasket 32 is greater than or equal to the surface area of the inspection port cover 34. The inspection port gasket 32 is suitable for reuse after removal and replacement of the inspection port cover 34 many times over a number of years. The inspection port gasket 32 is preferably formed of a resilient elastomer material such as nitrile rubber.

Figure 8:
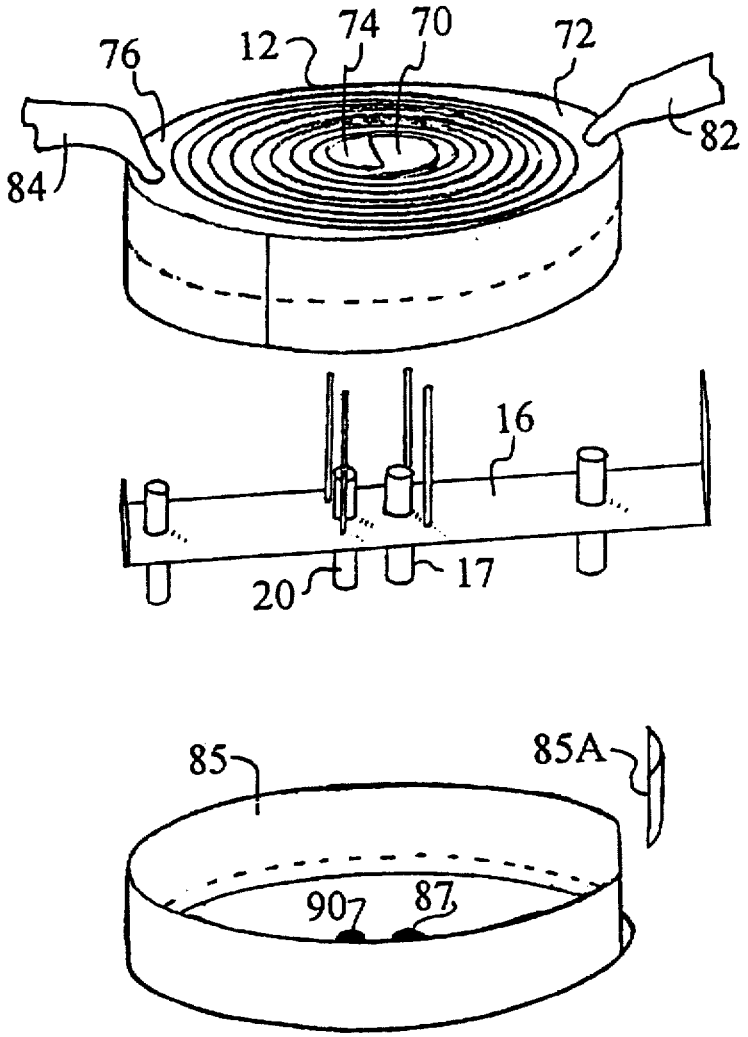
FIG. 8 illustrates a molding procedure for bonding the shell of the heat exchanger and the stanchion which supports the heat exchanger to a coiled strip which forms the fluid passages of the heat exchanger.

Method of Manufacture—Figure 8

To prepare the strip 13 for coiling, it is checked for defects and cut to a length corresponding to the total length to be coiled. A pattern may be imprinted on the portion of the strip which will form the helical fluid passages 22 and 24, if desired, to improve stiffness across the width of the strip and to induce turbulence in the fluid flowing through the fluid passages.

Blocks or inserts 70, 72, 74 and 76 shaped in profile as the desired flow transition chambers 40, 42, 44, and 46, and flexible spacer belts 82 and 84 of canvas, rubber or similar material of thicknesses corresponding to the minimum heights of the two fluid passages 22 and 24 may be used to fabricate the coil 12. The blocks 70, 72, 74 and 76 and the belts 82, 84 should not cover the entire width of the strip 13, such that a vacant space is provided between the wraps of strip which will be filled by the sealant 51 that bonds the coil 10 to the stanchion 16, and closes the edge of channels 22 and 24 adjacent to the stanchion. The dotted line on the coil 12 in FIG. 8 represents the maximum depth of insertion of the blocks 70, 72, 74 and 76 and the belts 82, 84 into the coil 12. The approximate midpoint of the width of strip 13 may be placed between the blocks 70 and 74 that are shaped as the center flow transition chambers 40 and 44. The strip 13 and the spacer belts 80 may be tightly wound around the blocks 70 and 74 shaped as center flow transition chambers until the desired channel length is attained. Spacer blocks 72 and 76 in the desired shape of the peripheral flow transition chambers 42 and 46 may then be placed in the appropriate positions, and the strip 13 wrapped over them. Excess length of belts 82 and 84 may pass through holes in the blocks 72 and 76 shaped as the peripheral flow transition chambers 42 and 46. The outer wrap of the strip 13 may then be attached to the adjacent inner wrap of the strip 13 to form the channel terminal 50.

Figure 3B:
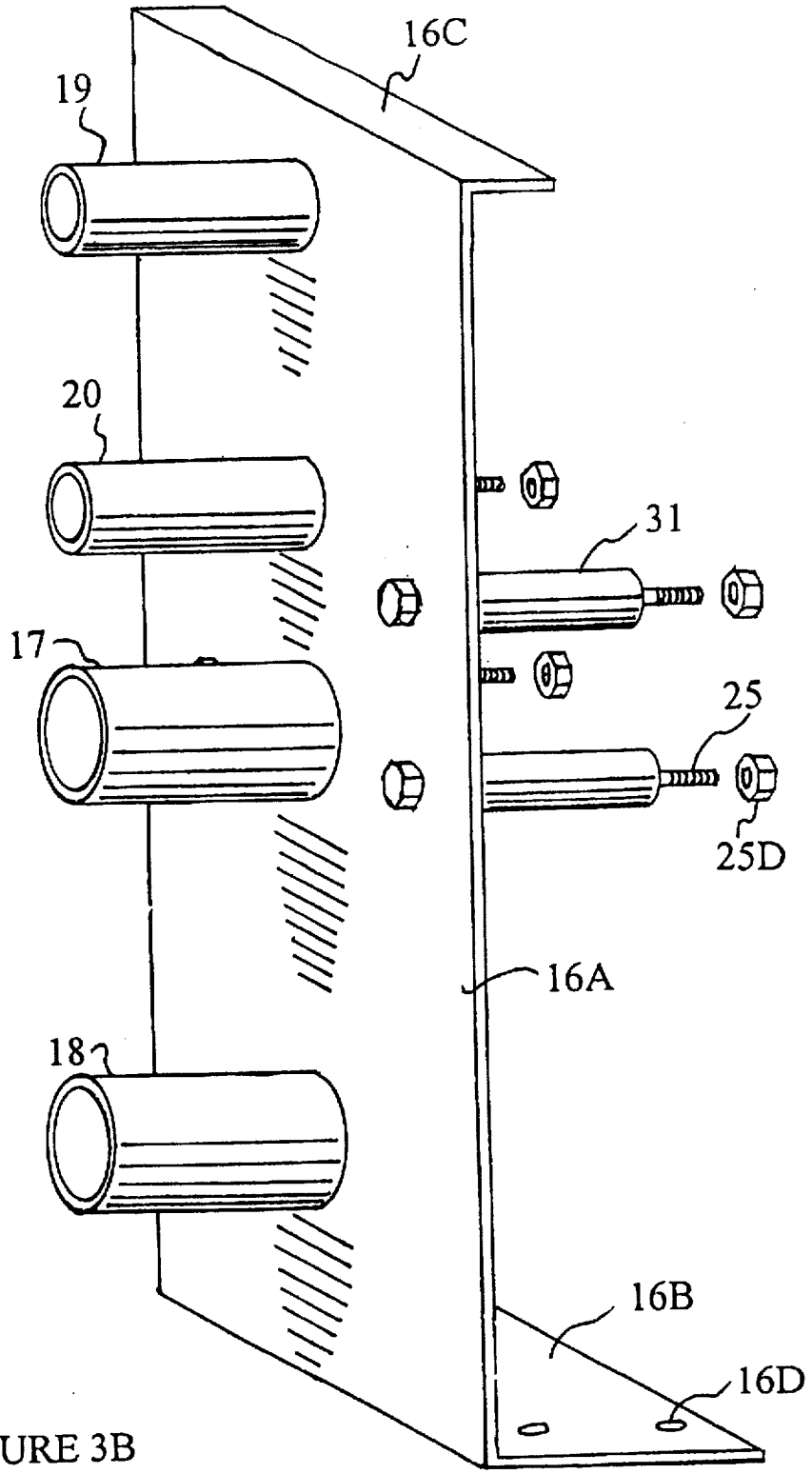

In the preferred embodiment, the stanchion 16 (see FIGS. 3A and 3B) is fabricated from metal plate sufficiently wide and thick to provide the desired strength to the heat exchanger. The plate is cut and formed into the desired shape of the brace portion 16A, the mount portion 16B, and the positioning guide portion 16C. Holes are made through the plate for fasteners 25 and fluid ports 17–20. The fasteners 25 are securely attached to the stanchion. The ports 17–20 are securely attached to the stanchion for example by welding or a threaded connection, or by attaching the ports to the stanchion with fasteners. The combination of stanchion 16, fasteners 25, and fluid ports 17–20 comprises the stanchion subassembly.

The first molding procedure illustrated in FIG. 8 bonds the stanchion 16 to the coil 12 in a horizontal mold 85. The mold 85 has openings 87–90 to allow the ports 17–90 to pass through and to allow the central portion 16A of the stanchion to avoid interference with the side of the mold. A cut away section 85A of the mold 85 provides clearance for the stanchion 16. The cut away side section 85A is replaced after the stanchion 16 is inserted horizontally into the bottom of the mold 85. A caulking or seal is used to contain the liquid sealant 51 at each of these openings.

After the mold 85 is caulked, liquid sealant 51 is poured into the mold 85 to approximately the depth shown by the dotted line on the mold in FIG. 8. The depth of sealant 51 immerses the central portion 16A of the stanchion, and when the coil is placed into the mold containing the stanchion 16 and sealant 51, the sealant extends up to the coiled strip 13 a distance adequate to provide a strong leakproof seal on the edge of coil 12. The depth of sealant 51 is not enough to contact the spacer blocks 70, 72, 74 and 76 or the belts 82, 84 holding the position of the wrapped strip 13.

The coil 12 is bonded to the stanchion subassembly by bringing together the stanchion subassembly, the coiled strip 13, and sealant 51 in a horizontal mold as described above. The positioning guide portion 16C of the stanchion is used to speed assembly by facilitating alignment of the coil 12 and the stanchion 16. After the sealant 51 has hardened, the spacer belts and blocks are removed through the open side of the coil 12. The remaining open edges of the fluid passages 22 and 24 may be closed by bringing together the coil 12 and sealant 51 in another horizontal mold.

Additional embodiments are shown in FIGS. 5A, 5B, 6, 7A and 7B. Each of these figures is a simplified sketch intended to emphasize details discussed in the text.

Figure 5A:
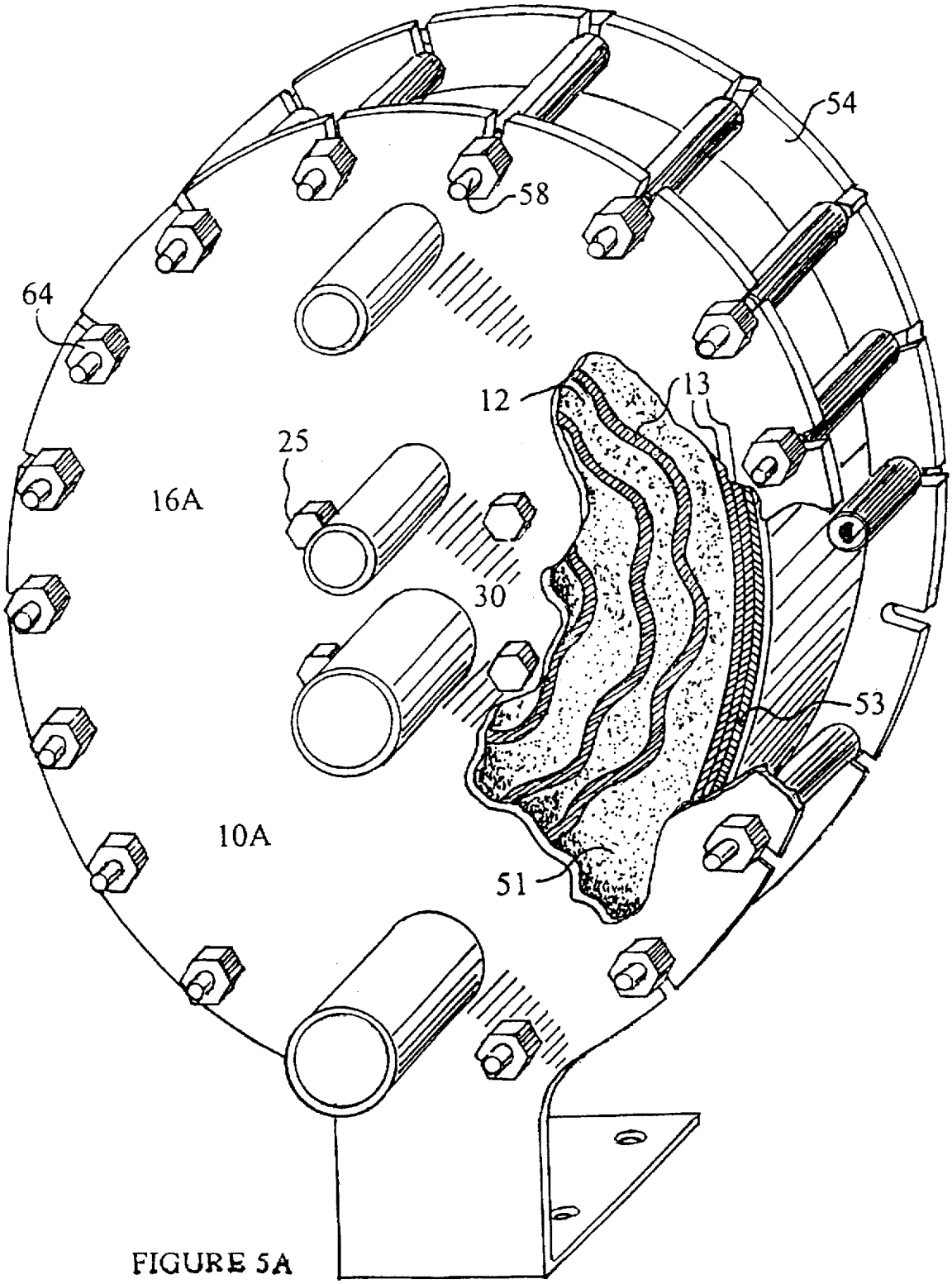
FIG. 5A is a rear perspective view, partly broken away, of another embodiment of a heat exchanger according to the invention for high pressure applications, but showing a reduced number of fluid passages enlarged for clarity.
Figure 5B:
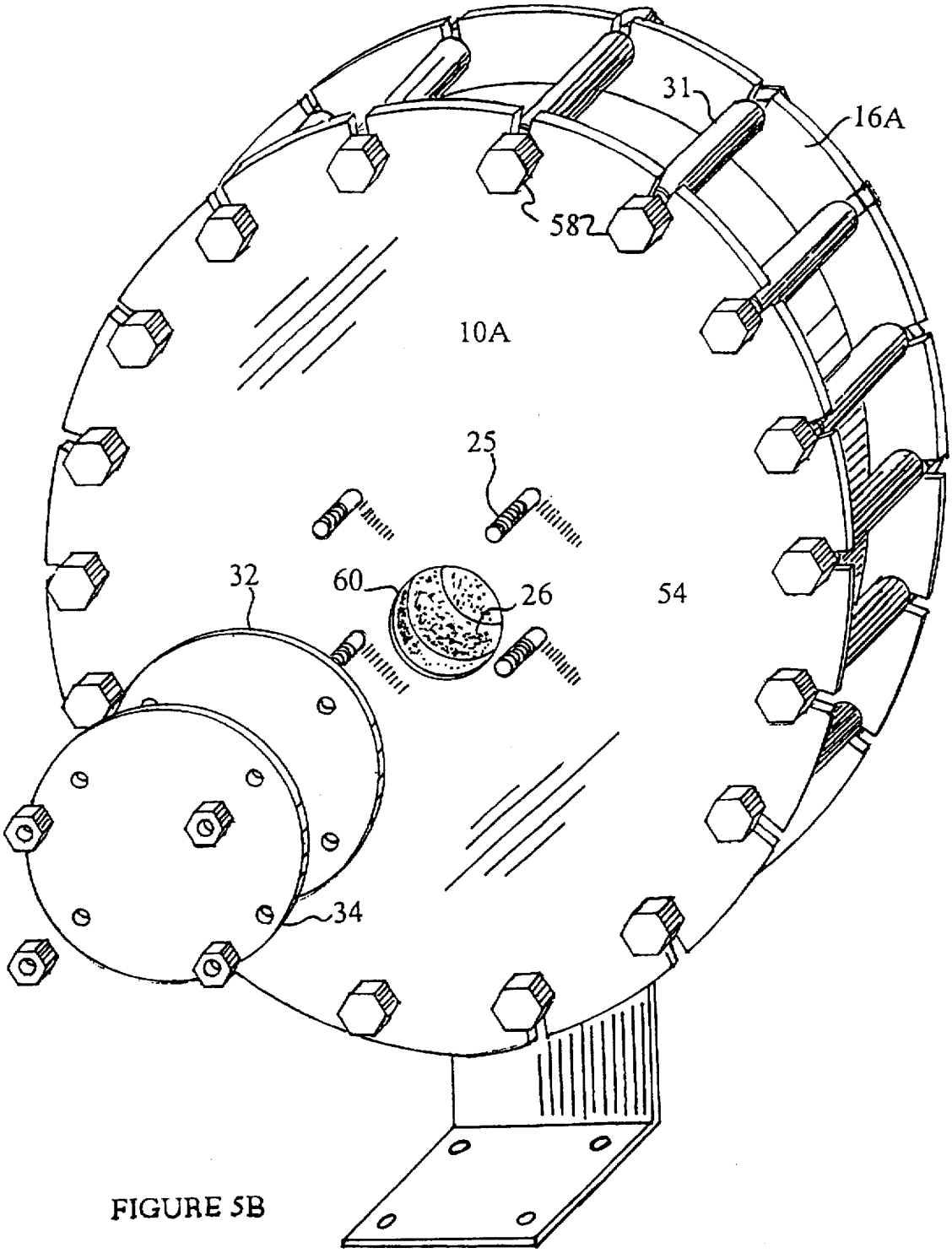
FIG. 5B is a front perspective view, partially exploded, of the heat exchanger depicted in FIG. 5A.

FIGS. 5A and 5B

FIGS. 5A (rear view), and 5B (front view) show a heat exchanger 10A reinforced for applications involving high design pressure. Compared to the stanchion 16 of the heat exchanger 10, the brace portion 16A of the stanchion 16 in the heat exchanger 10A has been increased in width, such that the brace portion approximates the perimeter of the coil 12. Also, the positioning guide portion 16C of the stanchion 16 of heat exchanger 10 has been eliminated in the stanchion 16 of heat exchanger 10A. On the edge of the coil 12 opposite the brace portion a containment plate 54 has been added. The containment plate 54 is fabricated of structurally strong material, preferably metal. The containment plate 54 is attached to the brace portion 16A by a number of fasteners 58 at the periphery, and by the fasteners 25 at the center 30 of the coil. Tubular spacers 31 may be used on the shanks of the fasteners 25 and 58. All fasteners lie outside the fluid passages 22 and 24 and throats 40A, 42A, 44A, and 46A. The containment plate 54 is fabricated with a hole 60 near its center which aligns with the inspection port 26. The hole approximates the size and shape of the inspection port. The inspection port 26 is closed and sealed by an inspection port cover 34 and an inspection port gasket 32.

Heat exchanger 10A also has a containment ring 53 which encircles the coil 12. The containment ring 53 may be fabricated of a strip of heavy gauge metal, which is the same width as the strip 13 used to fabricate the coil 12. The metal strip may be formed into a ring by securely fastening the ends together, preferably by welding. When viewed axially, the containment ring 53 has an elliptical shape slightly larger than the coil 13, such that the coil can fit snugly in the containment ring 53.

The thickness of the strip 13, the thickness of the inspection port cover 34, and the load capacity of the fasteners 25 at the coil center 30 are all increased. The depth of sealant 51 used to close the edges of the fluid passages 22 and 24 may be increased, and the strip 13 will be increased in width by an amount equal to the increased depth of sealant 51 closing the edges of the fluid passages 22 and 24. Both the brace portion 16A and the containment plate 54 may be stiffened by reinforcements. The mount portion 16B of the stanchion may be reinforced by a gusset.

FIG. 6

Figure 6:
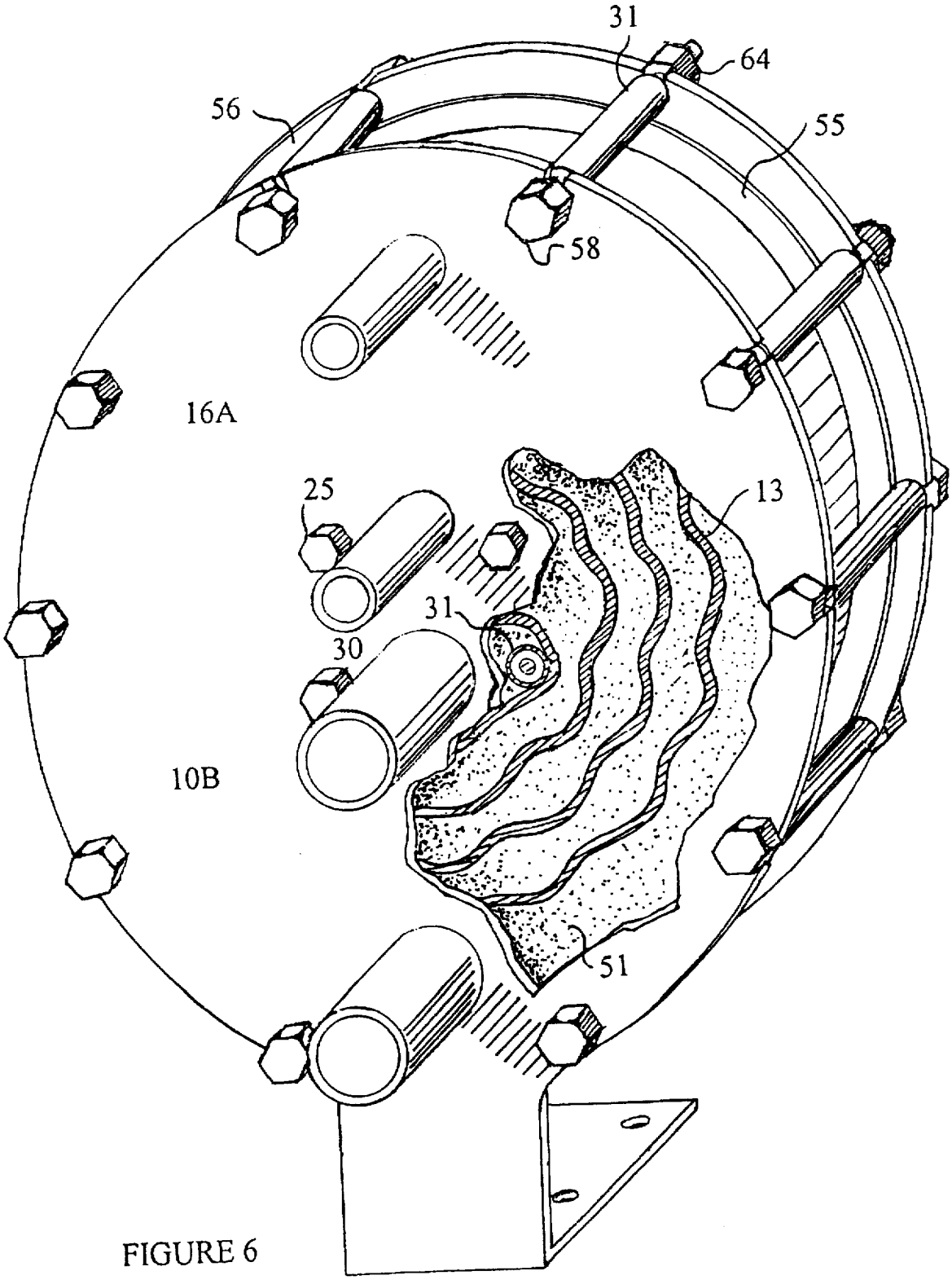
FIG. 6 is a rear perspective view, partly broken away, of another embodiment of a heat exchanger according to the invention having a removable channel maintenance cover to provide easy access to the fluid passages within the heat exchanger, but showing a reduced number of fluid passages enlarged for clarity.

FIG. 6 shows a heat exchanger 10B fabricated to allow inspection and thorough mechanical cleaning of both fluid passages 22 and 24. In comparison to the heat exchanger 10, only the edge of the fluid passages which is bonded to the stanchion 16 is closed by sealant 51. The other edge of the fluid passages is closed and sealed by a channel maintenance cover 56 with a channel maintenance cover gasket 55. The channel maintenance cover 56 and the channel maintenance cover gasket 55 are removable.

Compared to the stanchion 16 of the heat exchanger 10 described above, the positioning guide portion 16C of the stanchion 16 of heat exchanger 10 is eliminated. The width of the brace portion 16A is increased such that the brace portion approximates the perimeter of the coil 12. This enlargement of the brace portion is adequate to permit the placement of a number of fasteners 58 at the periphery extending between the brace portion 16A and the channel maintenance cover 56. The fasteners 58 are located outside the throats 42A and 44A and outside the fluid passages 22 and 24. With bolts used as fasteners, the bolts extend axially across the width of the coil 12, between the brace portion 16A and the channel maintenance cover 56. The bolts extend beyond the cover a sufficient distance to permit installation of a washer 62, lock washer 63, and a nut 64. Tubular spacers 31 may be installed on the shanks of the fasteners.

The strip 13 used to fabricate the coil 12 of heat exchanger 10B is narrower than the strip used in the heat exchanger 10 by a distance equivalent to the depth of sealant 51 which would have been used in the heat exchanger 10 to close the edges of the fluid passages 22 and 24 on the side of the coil opposite the brace portion 16A of the stanchion. The channel maintenance cover 56 is fabricated of structurally strong material, preferably metal plate, and is sufficiently sized to overlap the perimeter of the coil 12 and to be secured by the fasteners 25 and 58 extending from the brace portion 16A.

The channel maintenance cover 56 and the channel maintenance cover gasket 55 are pressed against the coil 12 by the ring of fasteners 58 at the periphery of the coil and by the fasteners 25 at the coil center 30. The channel maintenance cover 56 may also be attached to the brace portion 16A by a hinge. The channel maintenance cover gasket 55 may be formed from a sheet of elastomer which is compatible with the fluids circulating through the heat exchanger at the design conditions.

Figure 7A:
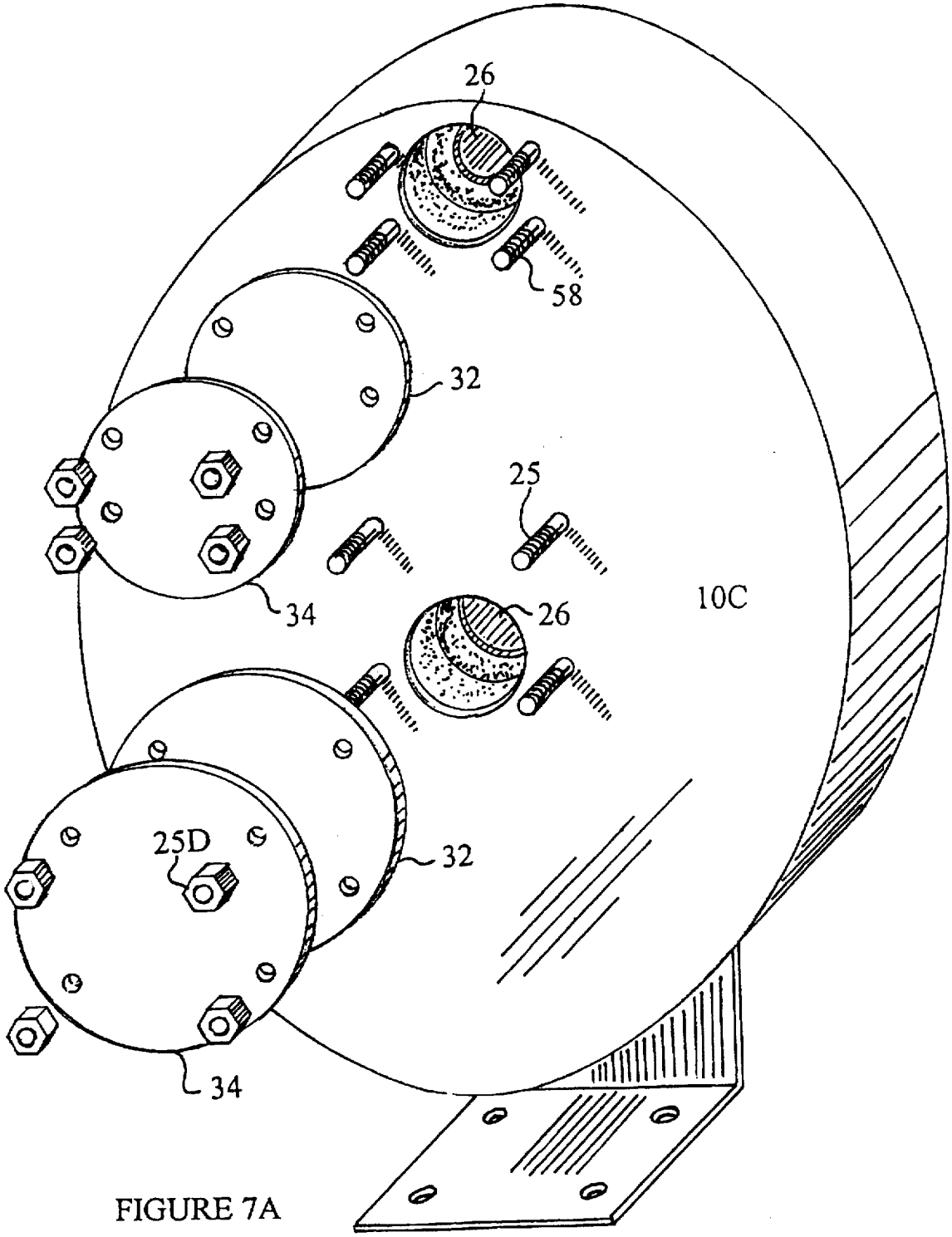
FIG. 7A is a front perspective view, partially exploded, of a heat exchanger according to another embodiment of the invention for use in applications in which both fluids carry fouling material.
Figure 7B:
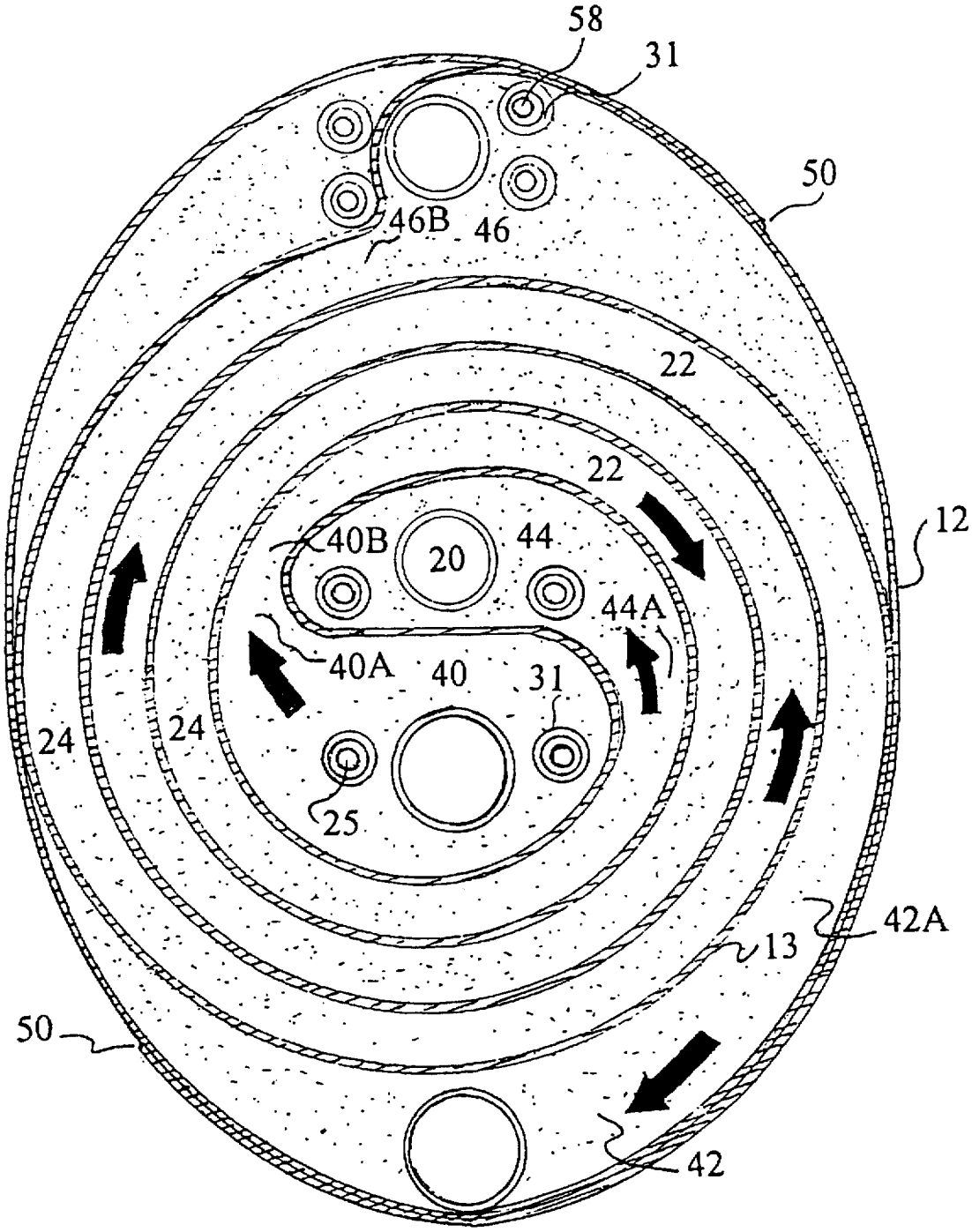
FIG. 7B is a radial axial section view of the heat exchanger depicted in FIG. 7A, but showing the heat exchanger with a reduced number of enlarged fluid passages for clarity.

FIGS. 7A and 7B

FIG. 7A provides an exterior view of a heat exchanger 10C for use with two fouling fluids. FIG. 7B shows the profile of the coil 12 fabricated for this application. In comparison with the heat exchanger 10, this variation features a large peripheral flow transition chamber 46 for fluid B in addition to the large center flow transition chamber 40 for fluid A. The large center flow transition chamber 40 for fluid A serves as the inlet into the fluid passage 22 for fluid A, and the large peripheral flow transition chamber 46 for fluid B serves as the inlet into the fluid passage 24 for fluid B.

The coil 12 is fabricated with an inspection port 26 into the center flow transition chamber 40 for fluid A and into the peripheral flow transition chamber 46 for fluid B. Each of the two inspection ports 26 penetrate through the side of the coil 12 opposite the brace portion 16A of the stanchion. Each inspection port is covered and sealed by an inspection port cover 34 and an inspection port cover gasket 32. At both inspection ports 26, fasteners 25 and 58 extend axially through the coil 12 between the brace portion 16A and the inspection port cover 34. These fasteners attach the inspection port gaskets 32 and the inspection port covers 34 to the side of the coil 12 opposite the brace portion 16A.

A slight constriction at the throat 40B may be formed between the center flow transition chamber 40 for fluid A and the fluid passage 22 for fluid A. Another slight constriction at the throat 46B may be formed between the peripheral flow transition chamber 46 for fluid B and the fluid passage 24 for fluid B. For a short length, the distance between adjacent wraps of strip 13 may be reduced to a distance which is slightly less than the distance between adjacent wraps of strip forming any other part of that fluid passage.

Operation

The spiral heat exchangers 10–10C are constructed to be mounted such that the inspection port cover 34 is assigned the most accessible orientation. The mount portion 16B of the respective stanchion is used to securely fasten the respective exchanger to an appropriate structure.

The inlet port 17 which enters the large center flow transition chamber 40 for fluid A serves as the inlet for fluid A (the fluid containing undissolved material). This potentially fouling fluid must flow upward from the center flow transition chamber 40 for fluid A to enter the fluid passage 22 for fluid A. Oversized material, unable to pass through the constriction at the throat 40B, remains in the center flow transition chamber 40 for fluid A, which is designed to hold a quantity of large undissolved material pending removal of that material during maintenance.

After entering the respective heat exchanger, undissolved materials suspended in fluid A will leave the heat exchanger by one of two ways. Either the undissolved materials are carried by fluid A through the helical fluid passage 22 for fluid A and exit through the outlet port 18 used to discharge that fluid, or the undissolved materials collect in the large center flow transition chamber 40 and are removed through the inspection port 26. In an effort to enable most of the undissolved materials to pass through the respective heat exchanger, a minimum distance is established between the adjacent wraps of strip 13 which form the fluid passage 22. For each application, the minimum spacing for adjacent wraps of strip 13 which form the fluid passage 22 will depend on the size distribution and fouling characteristics of the undissolved materials. Minimum spacing for common applications typically ranges from ¼ inch to ¾ inch. For each application a minimum velocity for fluid A will also be established. Minimum velocity for most common applications typically ranges from 1.8 to 3.0 feet per second.

The outlet port 18 through which the fouling fluid discharges is near the perimeter of the coil 12. This outlet port 18 may be near the top of the coil 12 or near the bottom, depending on the orientation of the strip 13 when formation of the desired length of the fluid passage for fluid A is completed.

Fluid B, the clean fluid, enters through the other inlet port 19 on the perimeter of the coil 12, and exits through the outlet port 20 which extends into the smaller center flow transition chamber 44 for fluid B. Clean fluids require neither a minimum velocity nor a minimum distance between adjacent wraps which form the fluid passage 24 for fluid B. Typically a small distance between adjacent wraps and a corresponding high fluid velocity are used, within the limits of available pressure drop.

The two fluids typically move through the respective spiral heat exchanger in counter current flow. A rippled pattern embossed into the strip 13 induces turbulence in the fluids for more efficient forced convective heat transfer.

To service heat exchanger 10 shown in FIGS. 4A&B, or heat exchanger 10A shown in FIGS. 5A&B, and to remove oversized material from the center flow transition chamber 40 for fluid A, the fasteners 25 at the coil center 30 are loosened. The inspection port cover 34 and the inspection port gasket 32 are removed, leaving the inspection port 26 open. Debris can be removed from the center flow transition chamber 40 through the inspection port 26. To place the respective heat exchanger back into service, the inspection port cover 34 and the inspection port gasket 32 are replaced, and the fasteners 25 are tightened. Tubular spacers 31 on the shanks of the fasteners protect the coil 12 from damage caused by over tightening the fasteners.

To service the heat exchanger 10B shown in FIG. 6, the fasteners 25 at the coil center 30 and the fasteners 58 at the periphery are all loosened. The channel maintenance cover 56 and the channel maintenance cover gasket 55 are removed, exposing the fluid passage 22 for fluid A, the fluid passage 24 for fluid B, and the flow transition chambers 40, 42, 44 and 46 at each end of each fluid passage. Unwanted material may be removed from the fluid passages and from the flow transition chambers by means of a brush. The heat exchanger may be closed by reinstalling the channel maintenance cover gasket 55 and the channel maintenance cover 56. The fasteners 25 at the coil center 30 and the fasteners 58 at the periphery are then tightened to complete the reassembly of the heat exchanger.

To service the heat exchanger 10C shown in FIG. 7A, the fasteners 25 at the coil center 30 and the fasteners 58 at the periphery are loosened. The two inspection port covers 34 and the two inspection port gaskets 32 are removed, thereby giving access to the two inspection ports 26. Debris may be removed from the center flow transition chamber 40 for fluid A and from the peripheral flow transition chamber 46 for fluid B through the two inspection ports 26. The heat exchanger may be made ready to be returned to service by reinstalling the two inspection port gaskets 32 and the two inspection port covers 34 over the two corresponding inspection ports 26. The fasteners 25 and 58 are then tightened.

Advantages

The heat exchanger of the present invention was developed with the goal of making energy recovery practical for applications which presently waste heat because no effective means of heat recovery is available. To be practical, the heat exchanger must offer better performance at lower cost than has ever been available before. To that end, the advantages of the inventive spiral heat exchanger over prior heat exchangers relate to lowering production costs, improving heat transfer performance, and lowering operating costs. From the description above, a number of advantages of my spiral heat exchanger become evident:

(a) The cost of fabrication of the heat exchanger is greatly reduced by substitution of inexpensive molding procedures for the expensive welding and machining procedures extensively required to fabricate other spiral heat exchangers.

(b) The innovative structure and method for sealing the edges of the fluid passages facilitates forming fluid channels of rippled thermally conductive strip, which is one of the distinguishing features of the invention. Rippled or embossed heat transfer surfaces generate higher shear forces and higher heat transfer coefficients than are generated in flow channels formed by the smooth strip typically used to fabricate other spiral heat exchangers. Less heat transfer surface is required, thereby lowering the material and labor production costs.

(c) The spiral heat exchanger of the present invention uses only two fluid channels, one for each of the two fluids flowing through the heat exchanger. Each fluid channel is designed and constructed to induce turbulence in the fluids flowing through the heat exchanger. This makes the heat exchanger resistant to accumulation of fouling materials on the wetted perimeter of the fluid passages.

(d) The spiral heat exchanger of the present invention resists fouling by stringy suspended solids because the passages are free of obstructions. The present invention does not depend on studs welded onto the strip or other contact points to maintain channel spacing. The unobstructed fluid passages permit long stringy solids to pass unhindered through the entire length of the fluid passage and to pass out of the heat exchanger.

(e) The constriction at the throat between the flow transition chamber and the fluid passage is designed to prevent suspended solids, which may be too large to pass freely through the fluid passage, from ever entering the fluid passage. These large suspended solids are accumulated in the large flow transition chamber. This facilitates removal of these oversized solids through an inspection port equipped with a removable cover.

Two Applications

In a typical food service industry application, one spiral heat exchanger would be used per dish washing machine, regardless of the capacity of the dish washing machine. The heat exchanger may be mounted beneath the dish washing machine, which usually stands at counter height. If space is limited in a particular application, two or more smaller spiral heat exchangers can be connected in series to obtain the desired heat transfer surface. The heat exchanger would typically be designed and fabricated to recover 60% to 80% of the temperature difference between the incoming fluid streams.

In a typical laundromat application, one spiral heat exchanger would serve a large number of washing machines. All heated wash water and rinse water would be discharged from the washing machines through the spiral heat exchanger. Clean water would be preheated in the spiral heat exchanger before flowing to the water heater for the washing machines.

The heat exchanger causes a pressure drop in each of the fluids flowing through it. The fouling fluid flows through a fluid passage formed by adjacent wraps of strip with relatively wide spacing. The wide spacing allows solids to pass through the heat exchanger with less likelihood of the solids bridging the fluid passage, causing fouling. The pressure drop through that passage is relatively low, usually 2 to 5 pounds per square inch. To optimize heat transfer, the clean fluid typically flows through a narrower passage. The pressure drop through that passage is usually 4 to 8 pounds per square inch. Adequate pressure to each fluid is needed to push the fluids through the heat exchanger.

The heat exchanger 10C shown in FIG. 7A would be favored by a commercial laundry, where cold used rinse water is heated and reused as wash water. Used hot wash water flows through one fluid passage 22 or 24, and used cold rinse water flows through the other. Both fluids contain fibers and probably other undissolved materials. Therefore both fluid passages 22 and 24 are provided with a constriction at throat 40B and 46B to prevent large objects from becoming lodged midway through a passage, and both transition chambers which serve as fluid inlets are provided with an inspection port 26 near the constriction, through which the debris may be easily removed.

Summary, Ramifications, and Scope

Accordingly, one will see that the spiral heat exchanger of this invention can be used to recover and recycle heat from liquids containing undissolved solids, and do so with very little maintenance.

The spiral heat exchangers according to the invention operate in recognition of the difference between undissolved materials which are small enough to pass through the heat exchanger, and large debris which may become lodged in the fluid passage. Small particles are allowed to flow through the fluid passage, but large particles are collected in the large flow transition chamber, from where they can be easily removed.

The invention provides:

- a simple, compact, and efficient heat exchanger, capable of recovering a major portion of the temperature difference between the two fluids passing through the heat exchanger;
- a heat exchanger which can be fabricated by simple and inexpensive procedures;
- a heat exchanger for which the design and fabrication procedure can be easily and inexpensively changed to produce heat exchangers to meet a wide variety of operating conditions and performance requirements;
- a strong heat exchanger designed and constructed to give a long service life, despite possible over tightening of pipes and fasteners during installation and maintenance procedures;
- a heat exchanger which reduces maintenance requirements by resisting the deposition and accumulation of undissolved materials;
- a heat exchanger which is responsive to chemical cleaning procedures;
- a heat exchanger encased in an attractive shell upon which company trademarks, and installation, operation, and maintenance instructions may be displayed;
- a means to recover energy, for which the value of the energy recovered far exceeds the combined installed and operating costs of the heat exchanger.

Although the description above contains many specificities, these should not be construed as limiting the scope of the invention, but as merely providing illustrations of some of the presently preferred embodiments of this invention. For example, the flow transition chambers can have other shapes; spacer belts composed of open cell foam, and saturated with sealant can be introduced to the sheet during coiling to hold the passage height and to close the passage ends; large particles may be removed from the fluid by a different method, such as a cylindrical screen attached to the inside of the inspection port cover, or by a device in the path of the fluid between the source of the fouling fluid and the fluid passage of the heat exchanger. Also, in some embodiments, the fluid passages need not extend spirally but may extend in other configurations such as sinuously, back and forth, or in other dense or spread out configurations. Further, the inlets and outlets may be formed and or attached to the heat exchanger in ways other than those described herein. Many other variations within the spirit and scope of the invention disclosed herein will be apparent to those of skill in the art from the disclosure herein, and it is intended that the claims cover such variations to the extent that the prior art allows. Additionally, the invention has application to heat transfer between many fluid mediums, both liquid and gaseous, and including but not limited to waste water Thus the scope of the invention should be determined by the appended claims and their legal equivalents, rather than by specific embodiments described herein.

What is claimed is:

1. A heat exchanger for indirect heat transfer between fluid media, comprising a heat-conducting strip extending for a substantial distance while changing direction a plurality of times and a seal at each opposite edge thereof to define first and second fluid passages extending for a substantial distance in a heat transferring relationship said seal for at least one of said edges comprising a sealant extending between adjacent runs of said strip adhered sufficiently to said one edge of said strip and sufficiently adjacent thereto to form said seal;

a first fluid inlet to said first passage;

a first fluid outlet from said first passage;

a second fluid inlet to said second passage; and a second fluid outlet from said second passage.

2. The heat exchanger according to claim 1 comprising a first fluid chamber in communication with said first fluid inlet defining a fluid passage between said first fluid inlet and said first fluid passage which is substantially larger in cross section than said first fluid passage, an opening to said first fluid chamber accessible from the exterior of said heat exchanger, and means for selectively closing said opening.

3. The heat exchanger according to claim 1 wherein said second fluid passage is unobstructed, said heat exchanger comprising a second fluid chamber communicating said second fluid inlet with said second fluid passage, said second fluid chamber defining a fluid passage between said second fluid inlet and said second fluid passage which is substantially larger in cross section than said second fluid passage, said heat exchanger comprising an opening to said second fluid chamber accessible from the exterior of said heat exchanger and means for selectively closing said opening.

4. The heat exchanger according to claim 1 wherein said heat-conducting strip extends spirally and is arranged to define adjacent spirally extending first and second fluid passages.

5. The spiral heat exchanger according to claim 4 wherein said strip and said seals are further arranged to define a first fluid chamber in communication with said first fluid inlet defining a fluid passage between said first fluid inlet and said first fluid passage which is substantially larger in cross section than said first fluid passage.

6. The heat exchanger according to claim 4 wherein said means define opposed walls of said first fluid passage and leave said first fluid passage unobstructed between said walls.

7. The heat exchanger according to claim 4 wherein one of said seals comprises a gasket adjacent another edge of said strip at least where said strip defines said first and second passages, and a plate, said plate urging said gasket against said another edge of said strip effective to seal said another edge of said strip.

8. The heat exchanger according to claim 7 comprising means removably mounting said plate to said heat exchanger.

9. A heat exchanger for indirect heat transfer between fluid media, comprising a stanchion;

a heat-conducting strip extending for a substantial distance while changing direction a plurality of times arranged with opposite edges thereof closed by a sealant to define adjacent first and second fluid passages of substantial length in a heat exchanging relationship with each other for substantial lengths thereof in which at least said first fluid passage is unobstructed, portions of said strip extending alongside said stanchion;

said sealant extending between adjacent runs of said strip adhered sufficiently to said one edge of said strip and sufficiently adjacent thereto to form a seal thereat, and sufficiently adhered to said stanchion and said strip to attach said strip to said stanchion so that said strip is supported by said stanchion;

a first fluid inlet communicating with said first fluid passage;

a first fluid outlet communicating with said first fluid passage spaced a substantial distance from said first fluid inlet;

a second fluid inlet communicating with said second fluid passage; and a second fluid outlet communicating with said second fluid passage spaced a substantial distance from said second fluid inlet.

10. The heat exchanger according to claim 9 comprising a first fluid chamber defined by said strip communicating said first fluid inlet with said first fluid passage, said first fluid chamber defining a fluid passage between said first fluid inlet and said first fluid passage which is substantially larger in cross section than said first fluid passage, said heat exchanger comprising an opening to said first fluid chamber accessible from the exterior of said heat exchanger and means for selectively closing said opening.

11. The heat exchanger according to claim 9 comprising a second fluid chamber defined by said strip communicating said second inlet with said second fluid passage, said second fluid chamber defining a fluid passage between said second fluid inlet and said second fluid passage which is substantially larger in cross section than said second fluid passage, said heat exchanger comprising an opening to said second fluid chamber accessible from the exterior of said heat exchanger and means for selectively closing said opening.

12. The heat exchanger according to claim 9 comprising a shell one side of which includes said stanchion.

13. The heat exchanger according to claim 9 wherein said fluid inlets and said fluid outlets are anchored to said stanchion.

14. The heat exchanger according to claim 9 wherein the cross section of at least one of said fluid passages varies over the length thereof to form numerous convergences and divergences and frequently changing the direction of the fluid flow therethrough as a means of establishing turbulence in fluid flowing therethrough and thereby improving heat transfer.

15. A spiral heat exchanger for indirect heat transfer between fluid media, comprising a spirally wound heat-conducting strip with opposite edges thereof sealed to define adjacent, spirally extending first and second fluid passages of substantial length in a heat exchanging relationship with each other for substantial lengths thereof;

a sealant extending between adjacent runs of said strip adhered sufficiently to said one edge of said strip and sufficiently adjacent thereto to form a seal thereat at least where said strip defines said first and second fluid passages, said sealant also engaging said strip sufficiently to space adjacent runs of said strip, a first fluid inlet communicating with said first fluid passage;

a first fluid outlet communicating with said first fluid passage spaced a substantial distance from said first fluid inlet;

a second fluid inlet communicating with said second fluid passage; and a second fluid outlet communicating with said second fluid passage spaced a substantial distance from said second fluid inlet.

16. A heat exchanger for indirect heat transfer between fluid media, comprising a heat-conducting strip extending for a substantial distance while changing direction a plurality of times and a seal at each opposite edge thereof to define first and second fluid passages extending for a substantial distance in a heat transferring relationship;

said seal for at least one of said edges comprising a sealant extending between adjacent runs of said strip permanently bonded to said one edge of said strip and sufficiently adjacent thereto to form said seal thereat;

a first fluid inlet to said first passage;

a first fluid outlet from said first passage;

a second fluid inlet to said second passage; and a second fluid outlet from said second passage.

17. A heat exchanger for indirect heat transfer between fluid media, comprising a heat-conducting strip extending for a substantial distance while changing direction a plurality of times and a seal at each opposite edge thereof to define first and second fluid passages extending for a substantial distance in a heat transferring relationship;

said seal for at least one of said edges comprising a sealant extending between adjacent runs of said strip bonded sufficiently to said one edge of said strip and sufficiently adjacent thereto to both form said seal at said one edge and space adjacent runs of said strip apart;

a first fluid inlet to said first passage;

a first fluid outlet from said first passage;

a second fluid inlet to said second passage; and a second fluid outlet from said second passage.

18. A heat exchanger for indirect heat transfer between fluid media, comprising a heat-conducting strip extending for a substantial distance while changing direction a plurality of times and a seal at each opposite edge thereof to define first and second fluid passages extending for a substantial distance in a heat transferring relationship;

said seal for at least one of said edges comprising a molded-in-place sealant extending between adjacent runs of said strip which forms said seal at said one edge of said strip;

a first fluid inlet to said first passage;

a first fluid outlet from said first passage;

a second fluid inlet to said second passage; and a second fluid outlet from said second passage.

19. The heat exchanger of claim 16 wherein said sealant is in an uncompressed state.

20. The heat exchanger of claim 17 wherein said sealant is in an uncompressed state.

21. The heat exchanger of claim 16 wherein said sealant is adhered to said strip without the use of mechanical fasteners.

22. A heat exchanger for indirect heat transfer between fluid media, comprising a heat-conducting strip extending for a substantial distance while changing direction a plurality of times and a seal at each opposite edge thereof to define first and second fluid passages extending for a substantial distance in a heat transferring relationship a first fluid inlet to said first passage;

a first fluid outlet from said first passage;

a second fluid inlet to said second passage; and a second fluid outlet from said second passage;

wherein said seal for at least one of said edges is made in accordance with the following method:

holding said strip in a configuration which forms said fluid passages with a liquid sealant in contact with said one edge of the strip and portions of said strip adjacent thereto extending between adjacent runs of said strip until said sealant hardens to engage and maintain the configuration of said strip and to seal said strip along said edge.

* * * * *